US009964116B2

(12) United States Patent
Watanabe

(10) Patent No.: US 9,964,116 B2
(45) Date of Patent: May 8, 2018

(54) INDUCER

(71) Applicant: EBARA CORPORATION, Tokyo (JP)

(72) Inventor: Hiroyoshi Watanabe, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 728 days.

(21) Appl. No.: 14/372,378

(22) PCT Filed: Jan. 17, 2013

(86) PCT No.: PCT/JP2013/050787
§ 371 (c)(1),
(2) Date: Jul. 15, 2014

(87) PCT Pub. No.: WO2013/108832
PCT Pub. Date: Jul. 25, 2013

(65) Prior Publication Data

US 2015/0010394 A1 Jan. 8, 2015

(30) Foreign Application Priority Data

Jan. 18, 2012 (JP) ..... 2012-008333

(51) Int. Cl.
*F04D 29/38* (2006.01)
*F04D 29/22* (2006.01)
*F01D 5/14* (2006.01)

(52) U.S. Cl.
CPC ..... *F04D 29/384* (2013.01); *F01D 5/145* (2013.01); *F04D 29/2277* (2013.01)

(58) Field of Classification Search
CPC ..... F04D 29/384; F04D 29/2277; F05D 5/145
See application file for complete search history.

(56) References Cited

U.S. PATENT DOCUMENTS 3,163,119 A 12/1964 Huppert
3,951,565 A 4/1976 Rothe et al.
(Continued)

FOREIGN PATENT DOCUMENTS

EP 1 536 143 A1 6/2005
JP 05-332300 A 12/1993
(Continued)

OTHER PUBLICATIONS

International Search Report for Application No. PCT/JP2013/050787 dated Apr. 16, 2013.
(Continued)

*Primary Examiner* — Richard Edgar
*Assistant Examiner* — Michael Sehn
(74) *Attorney, Agent, or Firm* — Pearne & Gordon LLP

(57) ABSTRACT

The present invention relates to an inducer geometry which can optimize the behavior stability of cavitation in an inducer having a plurality of blades of the same geometry. In the inducer having a plurality of blades of the same geometry, a blade loading at a tip side in a front half of a blade is larger than that in a rear half of the blade; and when a blade angle from a circumferential direction of the inducer is expressed by $\beta_b$ (degree) and a meridional distance is expressed by m (mm), an increase rate $d\beta_b/dm$ of the blade angle at the tip side is not less than 0.2 from a blade leading edge to a non-dimensional meridional location of 0.15, and the increase rate dβb/dm of the blade angle at a mid-span is not less than 0.25 from the blade leading edge to the non-dimensional meridional location of 0.15.

5 Claims, 39 Drawing Sheets

(56) References Cited

U.S. PATENT DOCUMENTS

| | | | | |
|---|---|---|---|---|
| 5,685,696 | A * | 11/1997 | Zangeneh | F01D 5/048 416/186 R |
| 6,065,929 | A | 5/2000 | Morel et al. | |
| 6,435,829 | B1 | 8/2002 | Meng et al. | |
| 7,097,414 | B2 | 8/2006 | Stangeland | |
| 7,207,767 | B2 | 4/2007 | Ashihara et al. | |

FOREIGN PATENT DOCUMENTS

| | | | |
|---|---|---|---|
| JP | 09-144699 | A | 6/1997 |
| JP | 2005-330865 | A | 12/2005 |
| JP | 4436248 | B2 | 1/2010 |
| WO | 2004-007970 | A1 | 1/2004 |

OTHER PUBLICATIONS

Supplementary European Search Report issued in Application No. EP 13 73 8762 dated Mar. 11, 2016.

* cited by examiner (a) cavitation volume in the case of 100%$Q_d$, $\sigma$ =0.066

(b) cavitation volume in the case of 120%$Q_d$, $\sigma$ =0.15

(c) cavitation volume in the case of 80%Qd, σ =0.071

$100\%Q_d$, $\sigma=0.066$ $100\%Q_d$, $\sigma=0.066$ $100\%Q_{th}$, $\sigma=0.066$ ψ : head coefficient
ψ∘: head coefficient reference value
η : efficiency
η∘: efficiency reference value
Q : flow rate
$Q_d$: design flow rate Nss : suction specific speed
Nsso: suction specific speed reference value inducer of Comparative Example 1 description of symbols

AC : asymmetrical cavitation
RC : rotating cavitation
CS : cavitation surge
MCS : mild cavitation surge fluctuation description of symbols

AC : asymmetrical cavitation
RC : rotating cavitation
CS : cavitation surge
MCS : mild cavitation surge fluctuation meridional geometry

INDUCER

TECHNICAL FIELD

The present invention relates to an inducer geometry which can minimize the cavitation instability behavior in an inducer having a plurality of blades of the same geometry.

BACKGROUND ART

Heretofore, in some cases, an axial-flow type impeller or a mixed-flow type impeller called inducer is mounted on a distal end of a main shaft to improve suction performance of a pump. Conventional inducer blades have been designed by a design method in which a blade angle along a tip of the blade is designed and a blade angle along a hub is determined based on the tip blade angle by helical conditions. A blade angle from an inlet (leading edge) to an outlet (trailing edge) of the tip of the inducer is designed to be constant or to increase stepwise, linearly, or quadratically in order to meet a head required for the inducer.

In the inducer, it is known that instability phenomena of cavitation behavior called rotating cavitation, cavitation surge, or the like are generated due to the development of cavitation generated on the blades when a pump inlet pressure is lowered. However, in the conventional inducer design method, an inducer blade geometry which suppresses the instability phenomena of cavitation has not been proposed.

CITATION LIST

Patent Literature

Patent document 1: Japanese patent No. 4436248

SUMMARY OF INVENTION

Technical Problem

The present invention has been made in view of the above circumstances. It is therefore an object of the present invention to provide an inducer which is derived by using a prediction and evaluation method which can predict and evaluate the behavior stability of cavitation from results calculated by steady CFD at a low cost without using unsteady CFD which is large in time cost and in calculation cost when performing optimum design of the inducer, used in a pump or the like, having a plurality of blades of the same geometry, and which can suppress the instability phenomena of cavitation behavior.

Solution to Problem

In order to achieve the above object, the present invention relates to an inducer which is derived by using a method for predicting and evaluating the stability of cavitation behavior in the inducer having a plurality of blades of the same geometry. The prediction and evaluation method is such a method that flow fields of the object to be predicted and evaluated are analyzed by CFD (Computational Fluid Dynamics), and pressure distributions in a specific direction on blade surfaces of respective blades are extracted and locations of characteristic pressure distribution forms of the pressure distributions of the respective blades are specified, and then variation in the respective locations is used as an evaluation index for representing the behavior stability of cavitation.

According to the prediction and evaluation method of the present invention for deriving the inducer, the flow fields of the object to be predicted and evaluated are analyzed by CFD, and the pressure distributions in the specific direction on the blade surfaces of the plural blades of the same geometry are determined. For example, blade-surface pressure distributions in a meridional direction of the respective blades are determined. Then, the locations of characteristic pressure distribution forms of the pressure distributions of the respective blades are specified. For example, in the case of the blade-surface pressure distribution, meridional locations where static pressures have their peak values are specified. Next, the variation in the respective specified locations is determined, and the variation in the respective locations is used as the evaluation index which represents the behavior stability of cavitation. For example, in the case where the meridional locations at which the static pressures have their maximum values are specified, when the meridional locations having the maximum values of the static pressures show large variation, it is evaluated that the instability of cavitation behavior is large, and when the meridional locations having the maximum values of the static pressures show small variation, it is evaluated that the instability of cavitation behavior is small.

Since there is a tendency that cavitation develops in the vicinity of a tip on a meridional surface of each blade, the pressure distribution in the specific direction is taken as a pressure distribution in the vicinity of the tip on the meridional surface of each blade. The fact that the locations of the maximum values in pressure distributions on suction surfaces of the respective blades differ from each other means that the pressure distributions of the respective blades differ from each other, and it is therefore considered that cavitation distributions have variation.

In order to determine an inducer geometry which can suppress the instability phenomena of the cavitation behavior, impact of design parameters of the inducer against the largeness of variation in the cavitation distributions is investigated. In this case, the design parameters include SLT which is a slope of a loading distribution at the tip side, SLH which is a slope of a loading distribution at a hub side, INCT which is an incidence at the tip side, INCH which is an incidence at the hub side, and an outlet vortex type such as a free vortex type or a forced vortex type. Some of these design parameters significantly affect the stability of cavitation behavior, and others insignificantly affect the stability of cavitation behavior. The sensitivity of these design parameters to the stability of cavitation behavior is predicted, and the inducer geometry which optimizes the stability of cavitation behavior is determined. The optimization of the stability of cavitation behavior includes an attempt to maximize the stability of cavitation behavior and an attempt to allow the behavior stability of cavitation to fall within an allowable range while maintaining the inducer performance.

According to the present invention, the inducer geometry which optimizes the stability of cavitation behavior determined by the above method is defined.

Specifically, according to the present invention, there is provided an inducer having a plurality of blades of the same geometry, characterized in that: a blade loading at a tip side in a front half of a blade is larger than that in a rear half of the blade; and when a blade angle from a circumferential direction of the inducer is expressed by $\beta_b$ (degree) and a meridional distance is expressed by m (mm), an increase rate $d\beta_b/dm$ of the blade angle at the tip side is not less than 0.2 from a blade leading edge to a non-dimensional meridional location of 0.15, and the increase rate $d\beta_b/dm$ of the blade angle at a mid-span is not less than 0.25 from the blade leading edge to the non-dimensional meridional location of 0.15.

According to a preferred aspect of the invention, the increase rate $d\beta_b/dm$ of the blade angle at the tip side is in the range of 0.2 to 2.0 from the blade leading edge to the non-dimensional meridional location of 0.15, and the increase rate $d\beta_b/dm$ of the blade angle at the mid-span is in the range of 0.25 to 2.0 from the blade leading edge to the non-dimensional meridional location of 0.15.

According to a preferred aspect of the invention, a blade geometry at the tip side is such blade geometry that the blade angle increases from the blade leading edge to the non-dimensional meridional location of 0.2, the increase rate of the blade angle with respect to the meridional distance decreases from 0.2 to 0.5 in the non-dimensional meridional location, the blade angle increases again from 0.5 to approximately 0.85 in the non-dimensional meridional location, and the blade angle decreases from the non-dimensional meridional location of approximately 0.85 to a blade trailing edge; and a blade geometry at the mid-span is such blade geometry that the blade angle increases from the blade leading edge to the non-dimensional meridional location of 0.2.

According to a preferred aspect of the invention, the blade geometry at the tip side is such blade geometry that from 0.2 to 0.5 in the non-dimensional meridional location, the increase rate of the blade angle with respect to the meridional distance decreases, but the blade angle itself does not decrease.

According to the present invention, there is provided a pump comprising: an inducer according to any of claims 1 to 4, an impeller disposed at a downstream side of the inducer; and a main shaft configured to support the inducer and the impeller.

Advantageous Effects of Invention

According to the inducer of the present invention, the high suction performance can be achieved and the instability phenomena of cavitation behavior can be suppressed.

DESCRIPTION OF EMBODIMENTS

Figure 1:
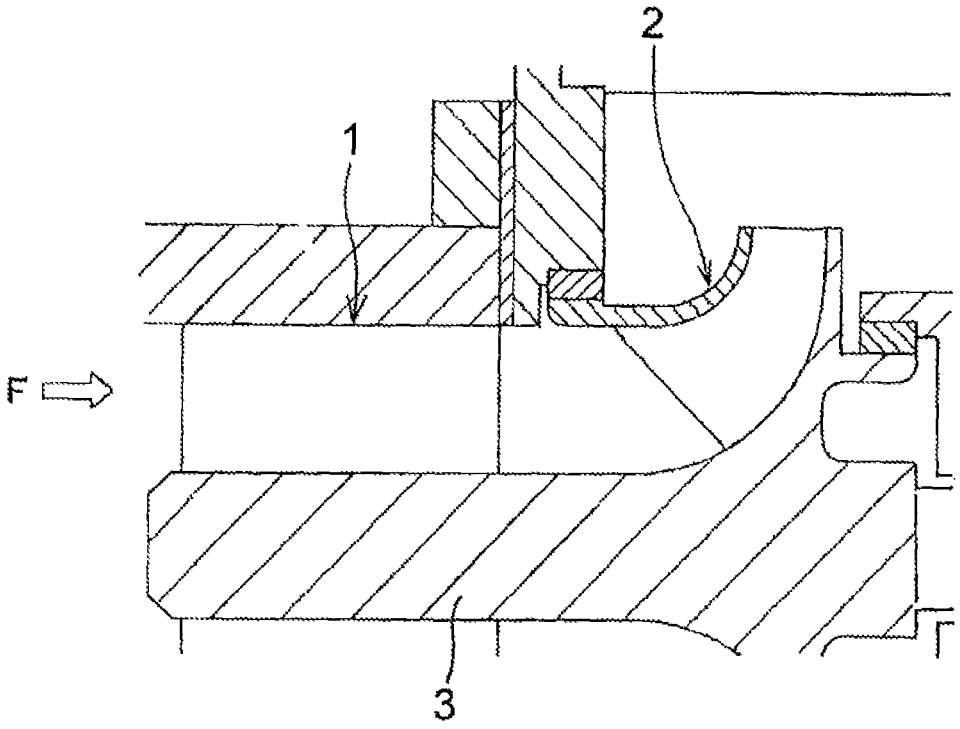
FIG. 1 is a cross-sectional view showing a portion of a turbopump incorporating an inducer according to an embodiment of the present invention.

Embodiments of an inducer according to the present invention which suppresses instability of cavitation behavior will be described in detail below with reference to drawings. In FIGS. 1 through 20, identical or corresponding parts are denoted by identical reference numerals, and will not be described in duplication.

FIG. 1 is a cross-sectional view showing a portion of a turbopump incorporating an inducer according to an embodiment of the present invention. The turbopump shown in FIG. 1 has an inducer 1, an impeller 2 disposed at a downstream side of the inducer 1, and a main shaft 3 for supporting the inducer 1 and the impeller 2. The inducer 1 has an axis in alignment with an axis of the impeller 2. When the main shaft 3 rotates, the inducer 1 rotates at the same rotational speed as the impeller 2.

A working fluid of the pump flows into the inducer 1 from the direction indicated by the arrow F of FIG. 1. The working fluid which has flowed into the inducer 1 is pressurized while generating cavitation in the inducer 1, and further pressurized by the downstream impeller 2 until the pressure of the working fluid is to be a head required by the pump. At this time, since the working fluid is pressurized by the inducer 1 to a pressure high enough not to generate cavitation in the impeller 2, the suction performance of the pump is significantly improved as compared to the case where the impeller 2 is used alone.

Figure 2:
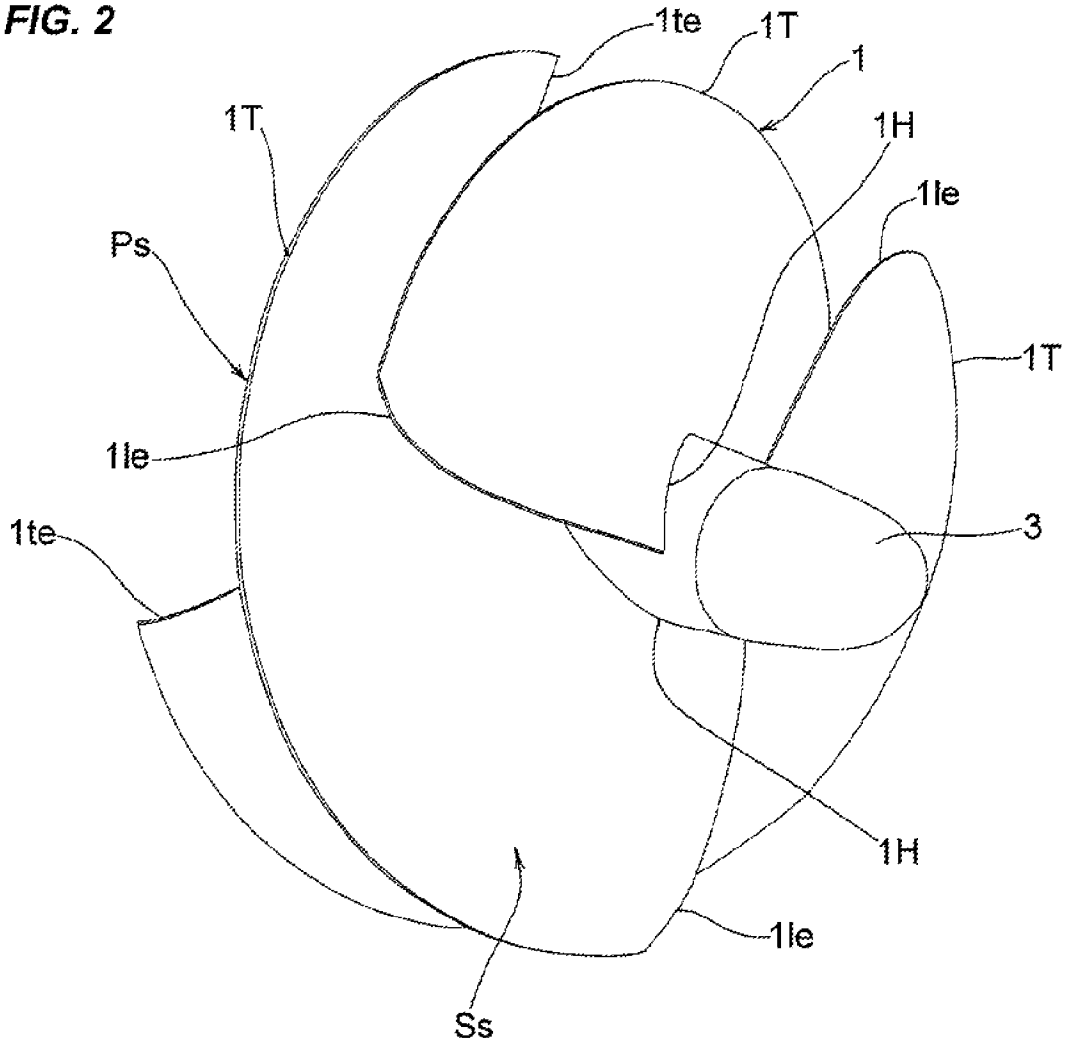
FIG. 2 is a perspective view of the inducer shown in FIG. 1.

FIG. 2 is a perspective view of the inducer shown in FIG. 1. The inducer 1 has a plurality of blades. FIG. 2 shows the inducer having three blades. As shown in FIG. 2, each of the three blades of the inducer 1 is formed in a helical-shape from a blade leading edge 1*le* toward a blade trailing edge 1*te*. Each blade extends radially from an inducer hub 1H at the main shaft 3 side toward an inducer tip 1T. In FIG. 2, the rear surface of the blade is a pressure surface Ps and the front surface is a suction surface Ss.

Next, instability phenomena of cavitation behavior generated on the inducer will be described.

Figure 3:
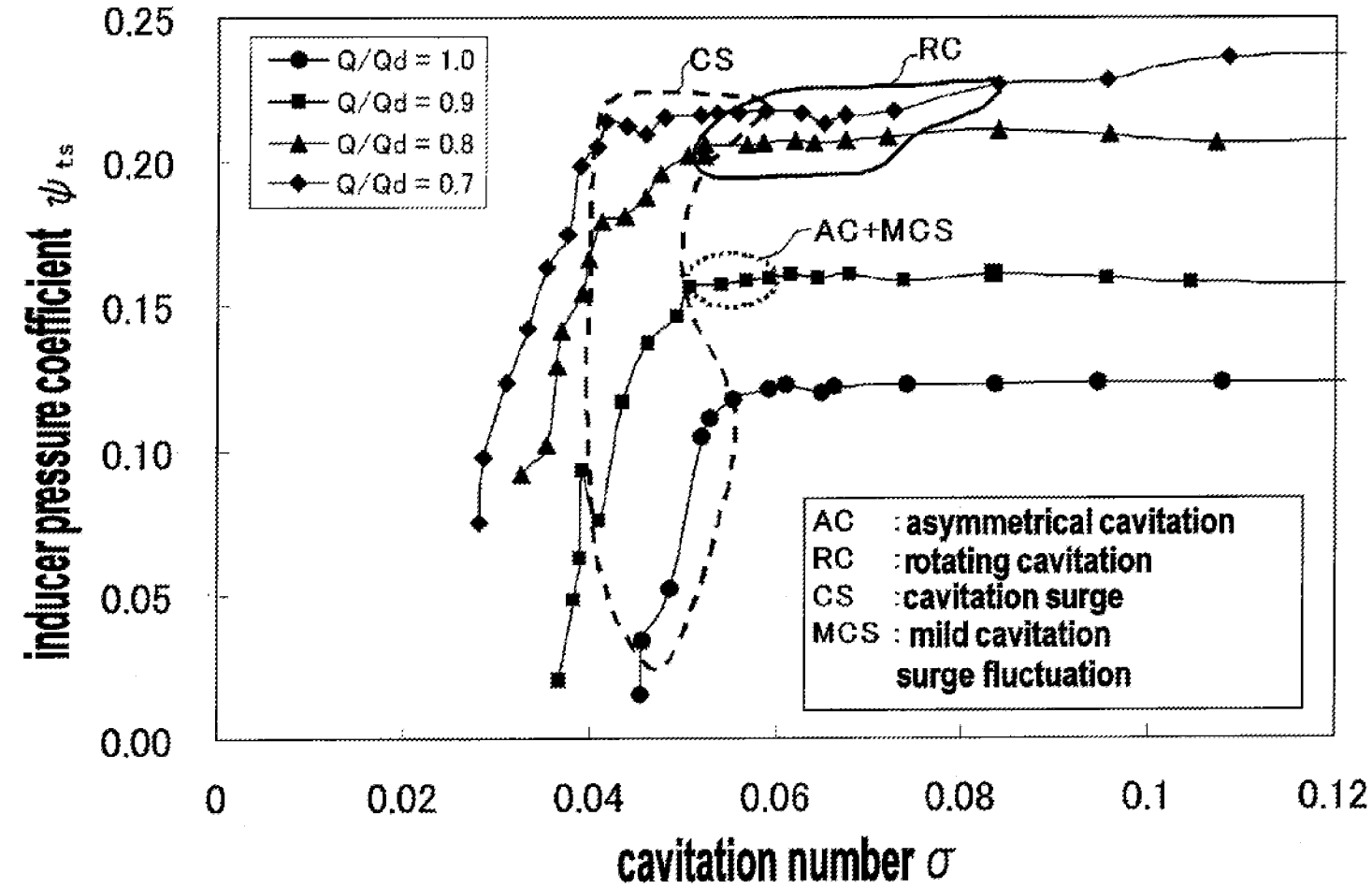
FIG. 3 is a view showing suction performance, and examples of occurrence regions and the kinds of instability phenomena of cavitation behavior in the inducer having three blades.

FIG. 3 is a view showing suction performance, and examples of occurrence regions and the kinds of instability phenomena of cavitation behavior in the inducer having three blades. In FIG. 3, the horizontal axis represents cavitation number $\sigma$ and the vertical axis represents inducer pressure coefficient $\psi_{ts}$. The cavitation number $\sigma$ is calculated from a pump inlet pressure Pt, a vapor pressure Pv of working fluid, a density $\rho$ of working fluid, and a circumferential velocity Ut at an inducer tip. Specifically, the cavitation number $\sigma$ is expressed by $\sigma=2(Pt-Pv)/\rho Ut^2$. The inducer pressure coefficient $\psi_{ts}$ is calculated from an inducer head H, the circumferential velocity Ut at the inducer tip section, and the gravity acceleration g. Specifically, the inducer pressure coefficient $\psi_{ts}$ is expressed by $\psi_{ts}=gH/Ut^2$.

FIG. 3 is a view in which results of experiments performed by changing an actual flow rate Q variously with respect to a design flow rate (flow rate at a design point) Qd using the inducer shown in FIG. 2 are plotted. In the experiments, the regions where the instability phenomena of cavitation behavior are generated are examined. FIG. 3 shows four flow rate ratios Q/Qd, with respect to the design flow rate Qd, which are 1.0, 0.9, 0.8 and 0.7.

In FIG. 3, a region enclosed by a solid line and regions enclosed by dotted lines are the regions where the instability phenomena of cavitation behavior were generated. In FIG. 3, the kinds of the instability phenomena of cavitation behavior are shown by the following symbols.

AC: asymmetrical cavitation (phenomenon where cavitation on the respective blades develops unevenly)

RC: rotating cavitation (phenomenon where cavitation propagates in a circumferential direction from a blade to a blade)

CS: cavitation surge (phenomenon where cavitation oscillates in an upstream direction and a downstream direction of the inducer in the interior of the inducer)

MCS: mild cavitation surge fluctuation

Conventionally, it has been an issue to predict and evaluate the behavior stability of cavitation and to establish a method for designing a stable inducer. However, as described above, unsteady CFD has been used for predicting the stability of cavitation behavior, causing problems of excessive time cost and calculation cost.

Therefore, in the present invention, a design method for evaluating the stability of cavitation behavior by steady CFD which is small in time cost is applied.

Next, a method for evaluating the behavior stability of cavitation by steady CFD will be described.

Figure 4:
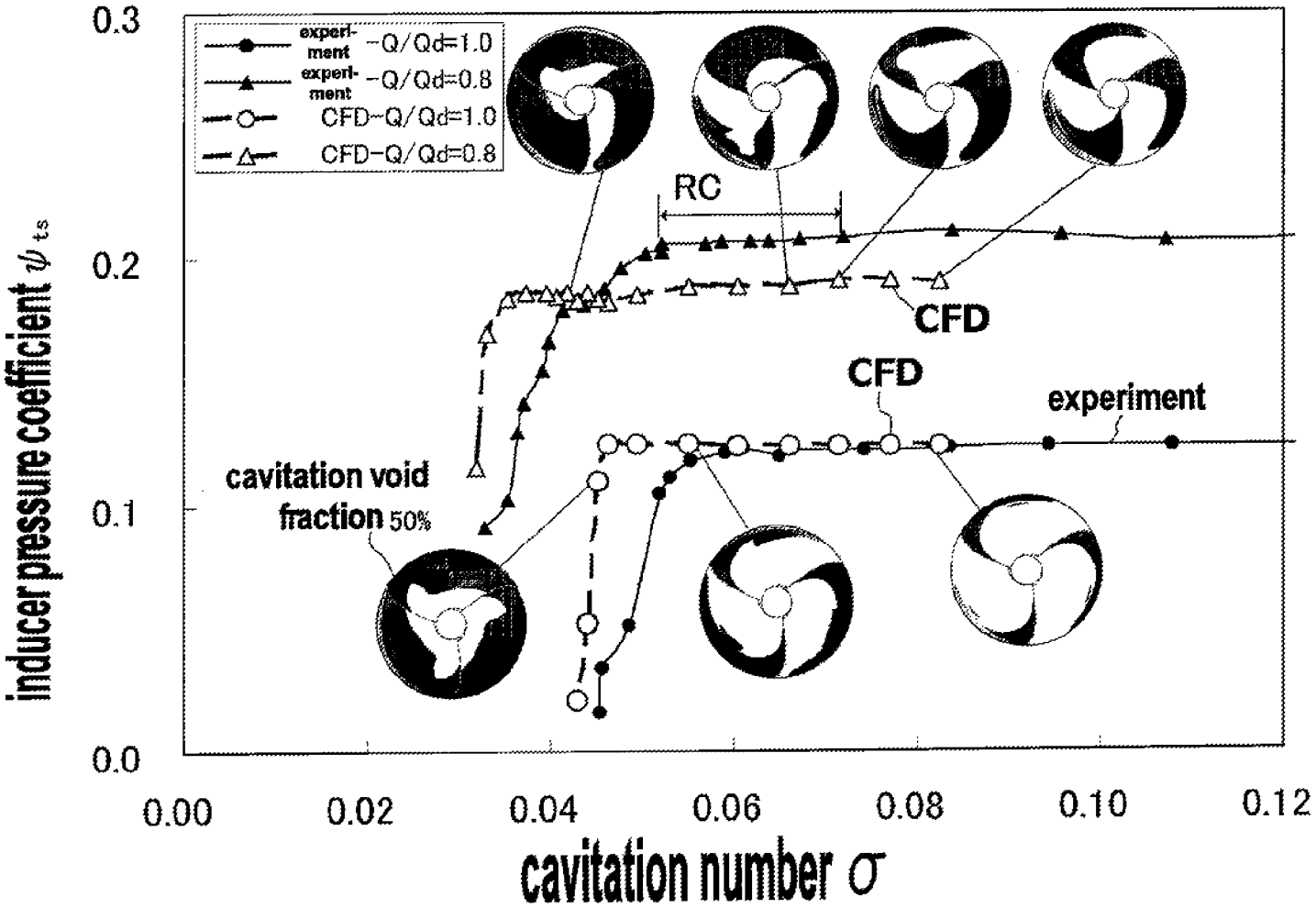
FIG. 4 is a view in which the suction performance of the inducer shown in FIG. 3 is compared with results calculated by steady CFD.

FIG. 4 is a view in which the suction performance of the inducer shown in FIG. 3 is compared with results calculated by steady CFD in the case where the flow rate ratios Q/Qd are 1.0 and 0.8. In FIG. 4, seven circular portions show geometries of the inducer, as viewed from front of the inducer, on which cavitation determined by steady CFD is generated. In the geometries, as viewed from front of the inducer, black colored portions are iso-surface of cavitation void fraction 50% and show distributions of cavitation developed on blade surfaces of the inducer. It is understood that the cavitation distributions shown by the black colored portions in the geometries which are the second and third from the left in the upper row of FIG. 4 display variation.

In FIG. 4, the region shown by RC, in the case where the flow rate ratio Q/Qd is 0.8, is a region where the rotating cavitation which is an unstable phenomenon of cavitation behavior is observed in the experiments. In the region shown by RC, it is confirmed that in steady CFD, there is variation in the distributions of the cavitation developed on the respective blades of the inducer as shown in FIG. 4. Specifically, it is confirmed that the region where the cavitation distributions display variation in steady CFD coincides with the operation range (shown by RC) where the instability of cavitation behavior appears in the experiments. In the flow rate ratio of 1.0 where the rotating cavitation is not generated, it is confirmed that the cavitation distributions determined by steady CFD do not display variation. Specifically, the results of steady CFD indicate the possibility that the instability of cavitation behavior can be evaluated by evaluating the variation in cavitation distributions developed on the respective blades of the inducer.

Figure 5A:
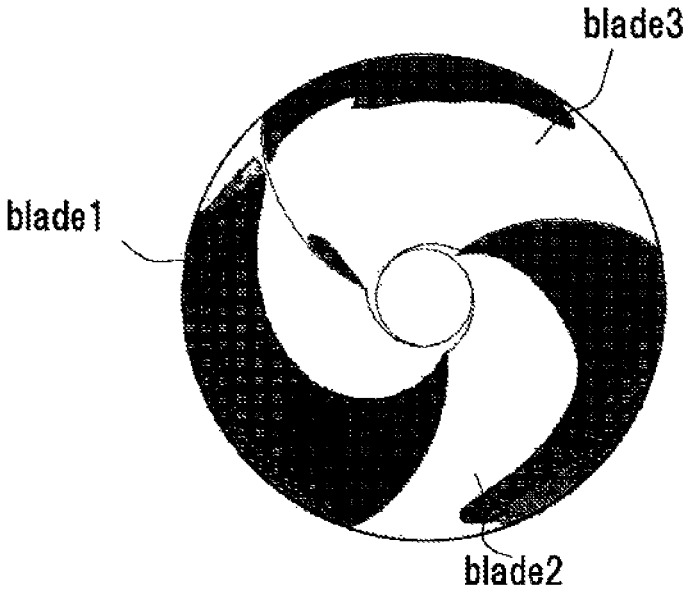
FIG. 5A is a view showing a geometry of the inducer, as viewed from front of the inducer, on which cavitation determined by steady CFD is generated.
Figure 5B:
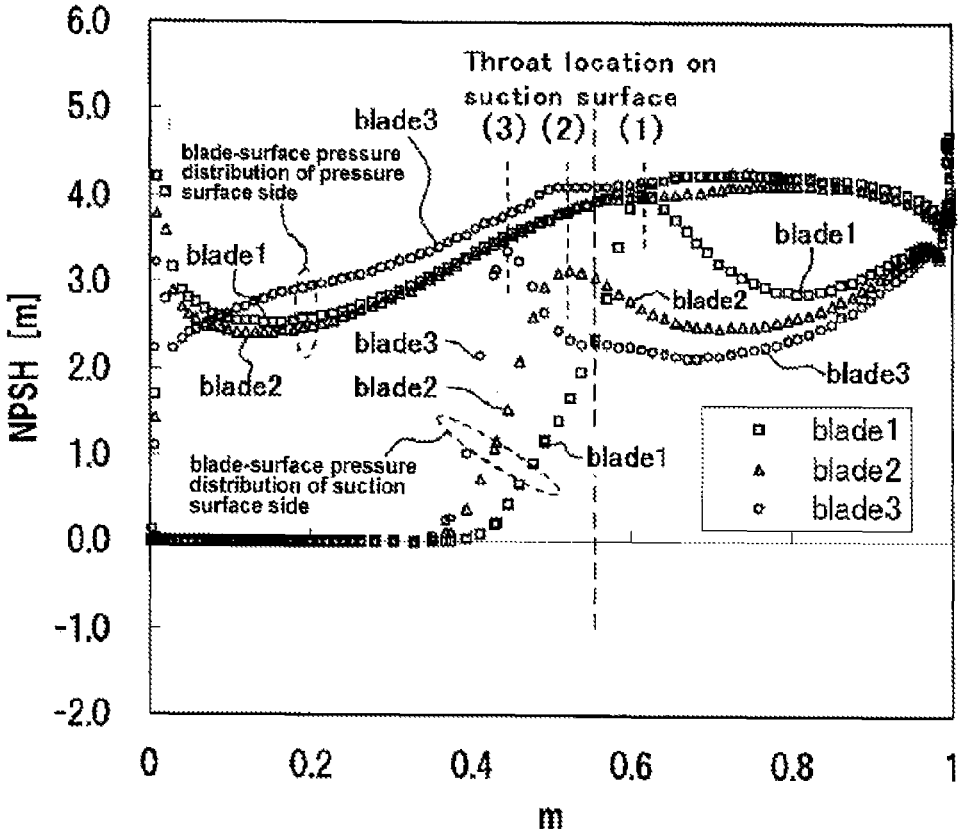
FIG. 5B is a view showing blade-surface pressure distributions near an inducer tip section on respective blades of the inducer.

Therefore, in order to quantitatively evaluate variation in cavitation distributions, in the case where the variation in cavitation distributions occurs as shown in FIG. 5A, the variation in blade-surface pressure distributions near the inducer tip section on the respective blades of the inducer as shown in FIG. 5B is used as an evaluation index.

FIG. 5A shows a geometry of the inducer, as viewed from front of the inducer, on which cavitation determined by steady CFD is generated. In FIG. 5A, black colored portions are iso-surface of cavitation void fraction 50% and show distributions of cavitation developed on blade surfaces of the inducer. As can be seen in the distributions of the black colored portions in FIG. 5A, the variation in the cavitation distributions is generated on three blades (blade1, blade2, blade3).

FIG. 5B is a view showing blade-surface pressure distributions near the inducer tip section on the respective blades of the inducer. In FIG. 5B, the vertical axis represents blade-surface pressure shown as head NPSH (m) of difference from a vapor pressure, and the horizontal axis represents normalized meridional location m, wherein m=0 indicates an inducer inlet and m=1 indicates an inducer outlet. FIG. 5B shows blade-surface pressure distributions at an inducer tip side (span=0.975). Here, span is a radial location from the inducer hub 1H to the inducer tip 1T. The location of the inducer hub 1H is span=0, and the location of the inducer tip 1T is span=1. The region where NPSH (net positive suction head) is zero is a region where the blade-surface pressure is a vapor pressure and cavitation is developed predominantly. As can be seen in the blade-surface pressure distributions on the suction surface side, it is understood that a static pressure surges from the region where NPSH is zero, i.e., the blade-surface pressure is the vapor pressure, toward the inducer outlet side, and that static pressures of the respective blades (blade1, blade2, blade3) have their maximum values at respective meridional locations shown by (1), (2), (3). As shown in FIG. 5A, it is understood that in the state where the cavitation distributions show variation in the respective blades, the meridional locations (1), (2), (3) representing the peak values of the static pressures also show variation. When the meridional locations show large variation, it is evaluated that the instability of cavitation behavior is large. When the meridional locations show small variation, it is evaluated that the instability of cavitation behavior is small.

Here, as a quantitative index which represents variation, variance $V_T$ of the meridional locations (1), (2), (3) having the peak values of the suction-surface pressures is determined by the following formula.

$$V_T=\{(m_1-m_{ave})^2+(m_2-m_{ave})^2+(m_3-m_{ave})^2\}/3 \quad (1)$$

Figure 6A:
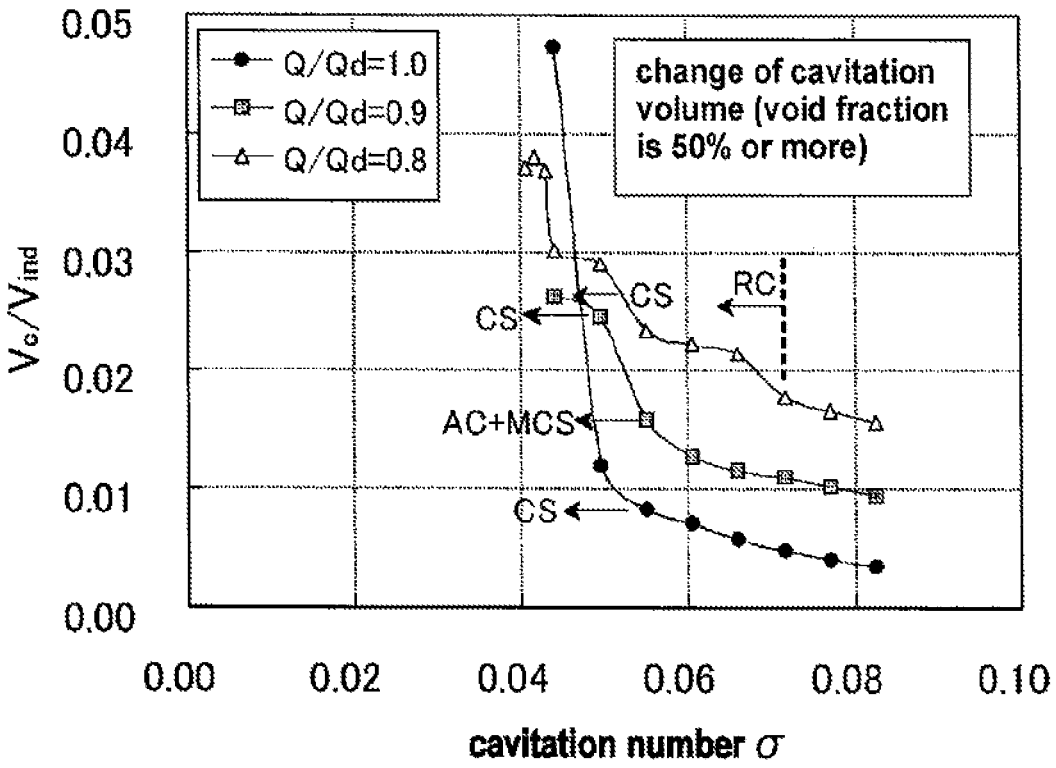
FIG. 6A is a view showing a change of volume $V_c$ of the region in the inducer in which cavitation void fraction is 50% or more (represented by $V_c/V_{ind}$ which is the ratio of the volume $V_c$ to volume $V_{ind}$ of a flow passage of the inducer) with respect to cavitation number $\sigma$.
Figure 6B:
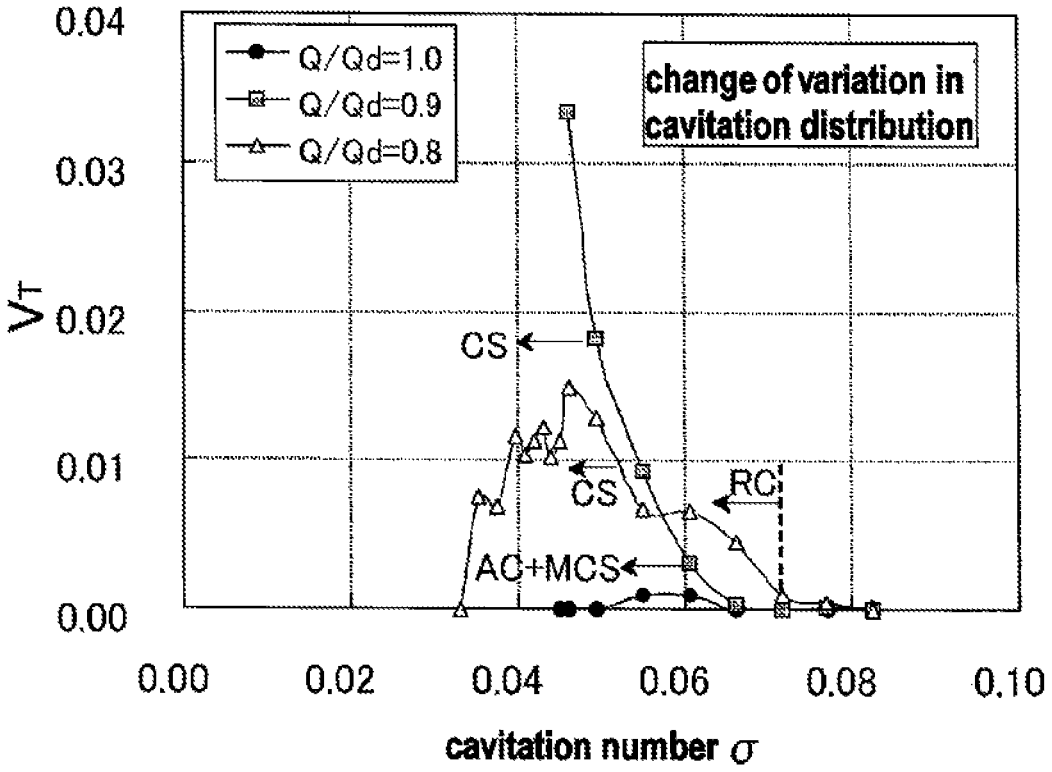
FIG. 6B is a view showing a change of variance $V_T$ of cavitation region in the inducer with respect to the cavitation number $\sigma$.

$m_1$, $m_2$, $m_3$: meridional locations (1), (2), (3) having the maximum values of the suction-surface pressures $m_{ave}$: the average value of $m_1$, $m_2$, $m_3$, $(m_1+m_2+m_3)/3$ FIGS. 6A and 6B are views showing a change of volume $V_c$ of the region in the inducer in which cavitation void fraction is 50% or more (represented by $V_c/V_{ind}$ which is the ratio of the volume $V_c$ to volume $V_{ind}$ of the flow passage of the inducer) and a change of the variance $V_T$ with respect to the cavitation number σ in the case of Q/Qd=1.0, Q/Qd=0.9, and Q/Qd=0.8. FIG. 6A shows a change of a cavitation volume and FIG. 6B shows a change of the variation in the cavitation distributions. In FIGS. 6A and 6B, occurrence regions of the instability phenomena of cavitation which have been confirmed by experiments as shown in FIG. 3 are shown by RC, CS, AC+MCS. It is recognized from FIGS. 6A and 6B that there is correlation between the occurrence regions of the instability phenomena of cavitation confirmed by the experiments and the changes of $V_c/V_{ind}$, $V_T$ determined by the steady cavitation CFD analysis. Specifically, in the case of Q/Qd=0.8, the rotating cavitation (RC) occurs in the cavitation number σ where there is variation in development of cavitation (change in σ=0.077→0.072). Further, the cavitation surge (CS) occurs in the portion where the variance $V_T$ increases in the region where the cavitation number σ decreases (σ=0.055→0.050). In such σ where $V_T$ increases, an increase rate of $V_c/V_{ind}$ to the decrease of σ is large.

In the case of Q/Qd=0.9, the asymmetrical cavitation accompanied by the mild cavitation surge fluctuation (AC+MCS) is generated in the cavitation number σ where there is variation in development of cavitation (change in σ=0.066→0.06). Further, the cavitation surge (CS) is generated in the portion where $V_T$, $V_c/V_{ind}$ increase in the region where the cavitation number u decreases (σ=0.055→0.050).

From the above results, $V_c/V_{ind}$ and $V_T$, determined by results of the steady cavitation CFD analysis, which represent the development state of cavitation in the inducer can be used as indexes representing ease of generation of the instability phenomena of cavitation. For example, in the design process of the inducer, on the basis of the results of the steady cavitation flow analysis, superiority or inferiority of the instability of cavitation can be judged by comparing the magnitudes of the variance $V_T$ at the same cavitation number σ.

Further, although the variance $V_T$ of the locations having the peak values in the blade-surface pressure distributions at the inducer tip side of respective blades has been evaluated, in order to evaluate the variation in the cavitation distributions of the respective blades based on the results calculated by steady CFD, superiority or inferiority of the instability of cavitation can be similarly judged by evaluating the variation in the cavitation volumes/volumes having a predetermined pressure or less on the respective blades, or the variation in the geometries of the cavitation regions on the respective blades.

Specifically, the continuous regions, having a predetermined pressure or less, e.g. regions having a vapor pressure or less are extracted from the blade surfaces of the respective blades by steady CFD, and volumes occupied by the respective extracted regions are specified as with the case of cavitation void fraction, and the variation in respective volumes is evaluated. Thus, superiority or inferiority of the instability of cavitation can be judged.

Further, the continuous regions, having a predetermined pressure or less, e.g. the regions having a vapor pressure or less are extracted from the blade surfaces of the respective blades by steady CFD, and the geometries of the respective extracted regions are specified, and the variation in the respective geometries themselves are evaluated. Thus, superiority or inferiority of the instability of cavitation can be judged.

As described above, the inventors of the present invention have prepared a plurality of geometries, to be predicted, which differ in a specific design parameter, and have predicted the sensitivity of the geometries with respect to the behavior stability of cavitation by using steady CFD, and have performed the design optimization of the inducer, including the behavior stability of cavitation.

Figure 7:
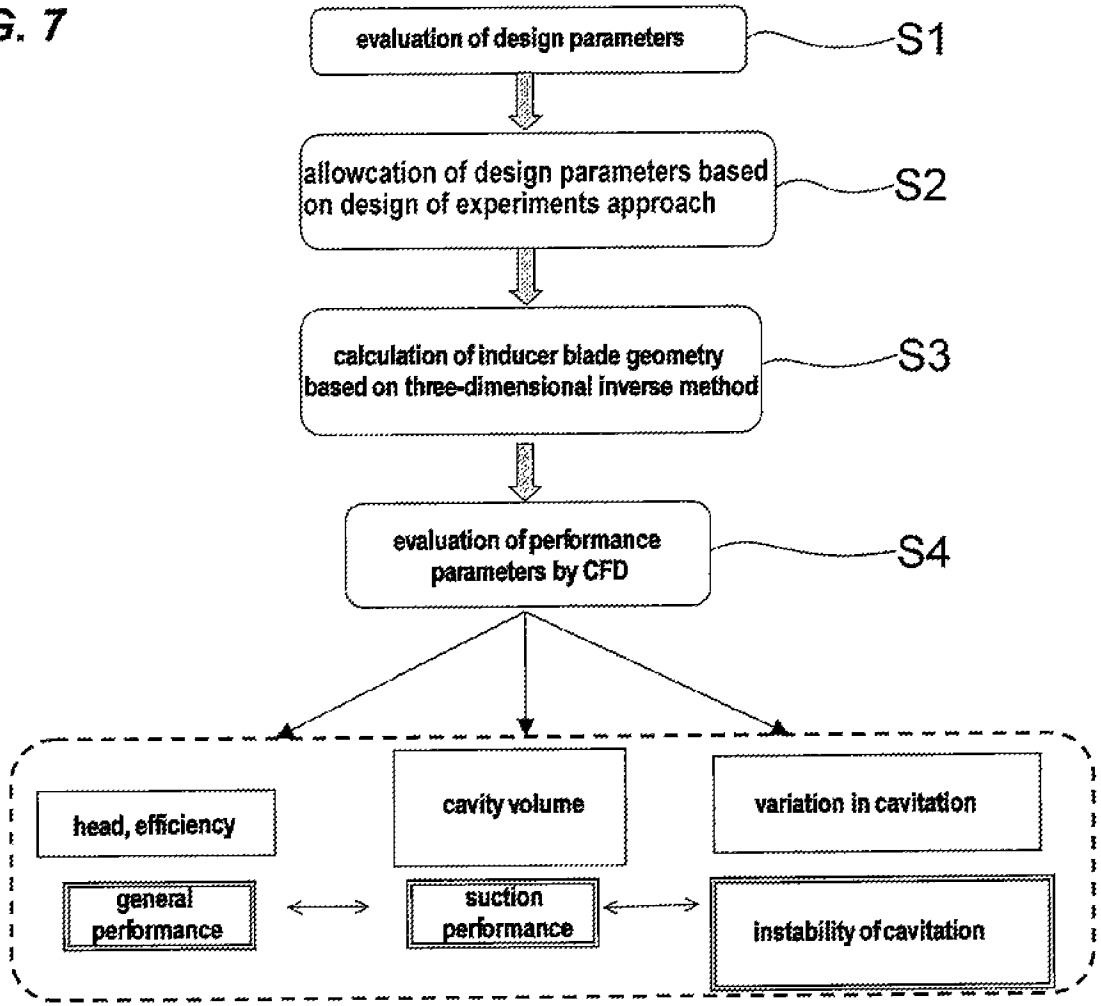
FIG. 7 is a flowchart showing an example of design optimization of the inducer including the behavior stability of cavitation.
Figure 8A:
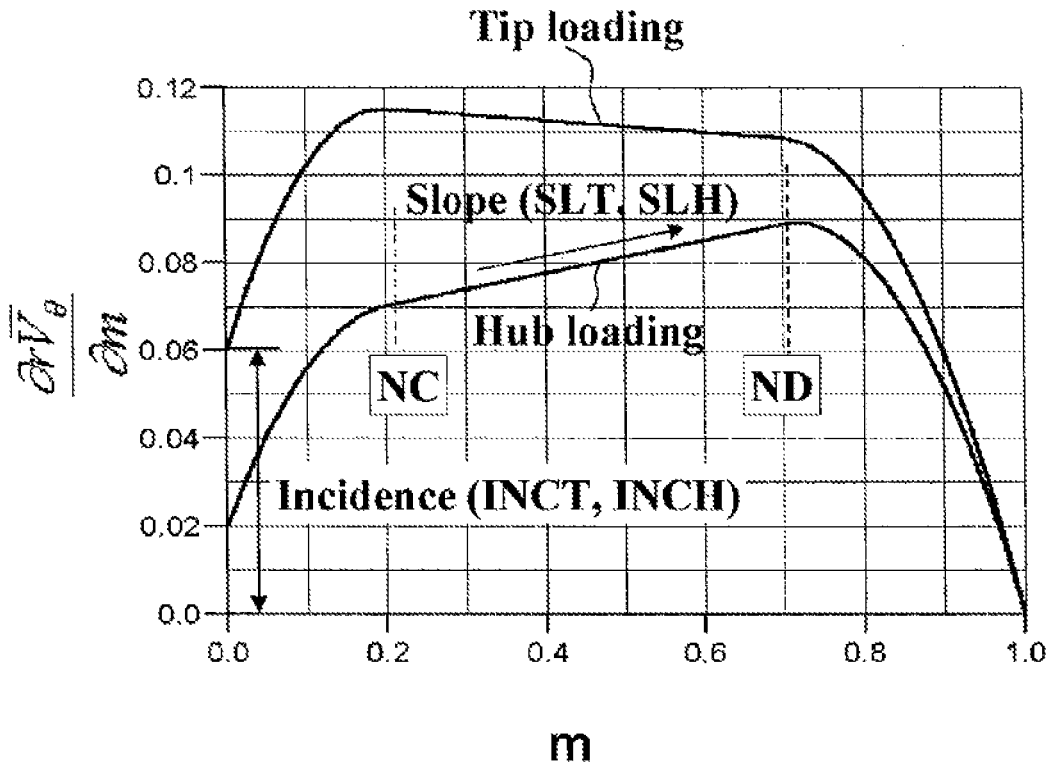
FIG. 8A is a view showing examples of design parameters and FIG. 8A shows parameters for setting inducer loading distributions at a hub side and at a tip side.
Figure 8B:
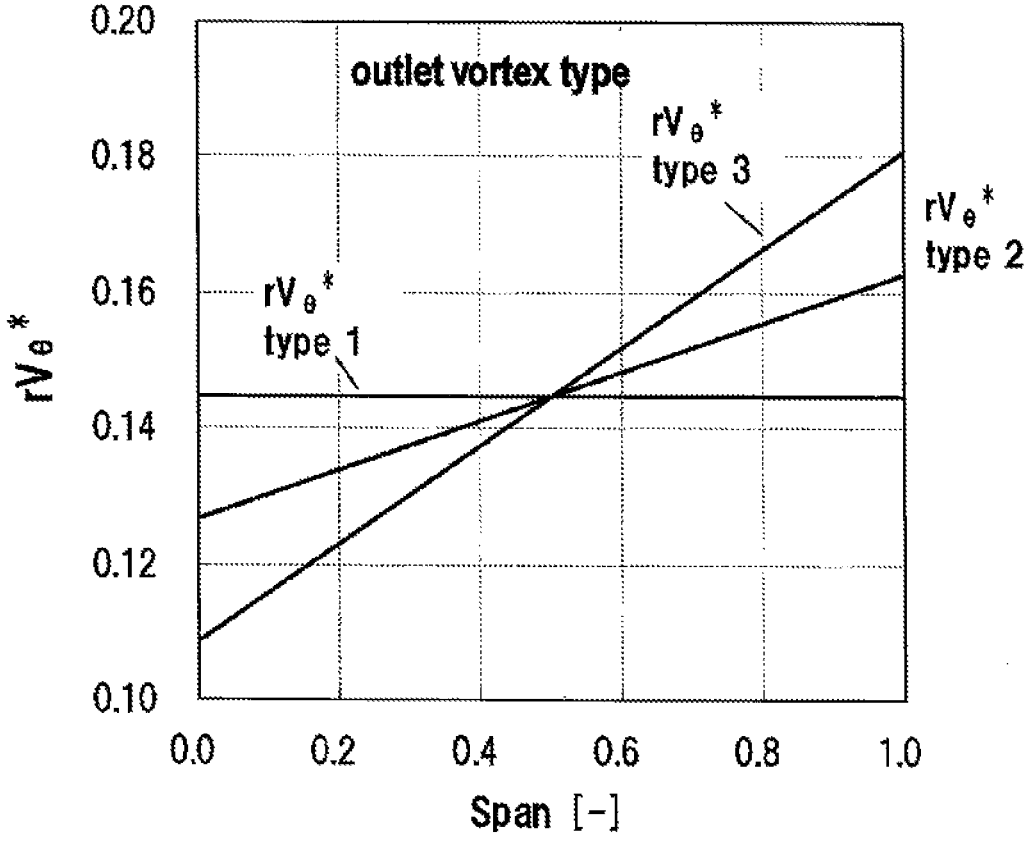
FIG. 8B is a view showing examples of the design parameters and FIG. 8B shows parameters for setting outlet vortex types.

FIG. 7 is a flowchart showing the design optimization of an inducer considering the stability of cavitation behavior. As shown in FIG. 7, design parameters are evaluated as a first step S1. FIGS. 8A and 8B are views showing examples of design parameters. FIG. 8A shows parameters for setting inducer loading distributions at the hub side and at the tip side and FIG. 8B shows parameters for setting outlet vortex types.

In FIG. 8A, the horizontal axis represents normalized meridional location, wherein m=0 indicates an inducer inlet and m=1 indicates an inducer outlet, and the vertical axis represents inducer loading distribution $\partial(rV_\theta)/\partial m$ ($rV_\theta$ is angular momentum, m is meridional location). As shown in FIG. 8A, the design parameters include SLT which is a slope of the loading distribution at the tip side and SLH which is a slope of the loading distribution at the hub side. Further, the design parameters include INCT which is an incidence at the tip side and INCH which is an incidence at the hub side.

In FIG. 8B, the horizontal axis represents span, wherein span=0.0 indicates a location of the inducer hub and span=1.0 indicates a location of the inducer tip, and the vertical axis represents distribution of non-dimensional $rV_\theta$* in a span direction at the inducer outlet (corresponding to Euler head coefficient). In FIG. 8B, $rV_\theta$*type1 represents a free vortex type, and $rV_\theta$*type2 and $rV_\theta$*type3 represent a forced vortex type in which $rV_\theta$* at the tip-side is larger than that at the hub-side. As shown in FIG. 8B, the design parameters include the outlet vortex types of $rV_\theta$*type1, $rV_\theta$*type2, and $rV_\theta$*type3, and these outlet vortex types will be represented by RVT in the following description.

As described above, after evaluation of the design parameters, as a second step S2, design parameters are allocated based on design of experiments approach as shown in FIG. 7. Here, the design of experiments approach is used, for example, in an attempt to improve characteristics of a process, product or the like as an object and to optimize such characteristics, and refers to a statistical experiment approach to find a cause which is considered to influence such characteristics and to quantify the degree of effect of such cause by a small number of experiments (simulations).

Next, as a third step S3, an inducer blade geometry is calculated by a three-dimensional inverse method. The three-dimensional inverse method is a method proposed by Dr. Zangeneh of UCL (University College London) in 1991. The three-dimensional inverse method is a design method for defining a loading distribution on the blade surface and determining a blade surface geometry that meets the loading distribution according to numerical calculations. Details of the three-dimensional inverse method are described in a known document (Zangeneh, M., 1991, "A Compressible Three-Dimensional Design Method for Radial and Mixed Flow Turbomachinery Blades", Int. J. Numerical Methods in Fluids, Vol. 13. pp. 599-624).

In the inducer according to the present invention, the blade geometry is calculated based on the three-dimensional inverse method.

Next, as a fourth step S4, performance parameters are evaluated by steady CFD. Objects to be evaluated are head, efficiency as the general performance parameter and suction performance, instability of cavitation behavior, and the like, as shown in FIG. 7.

Figure 9A:
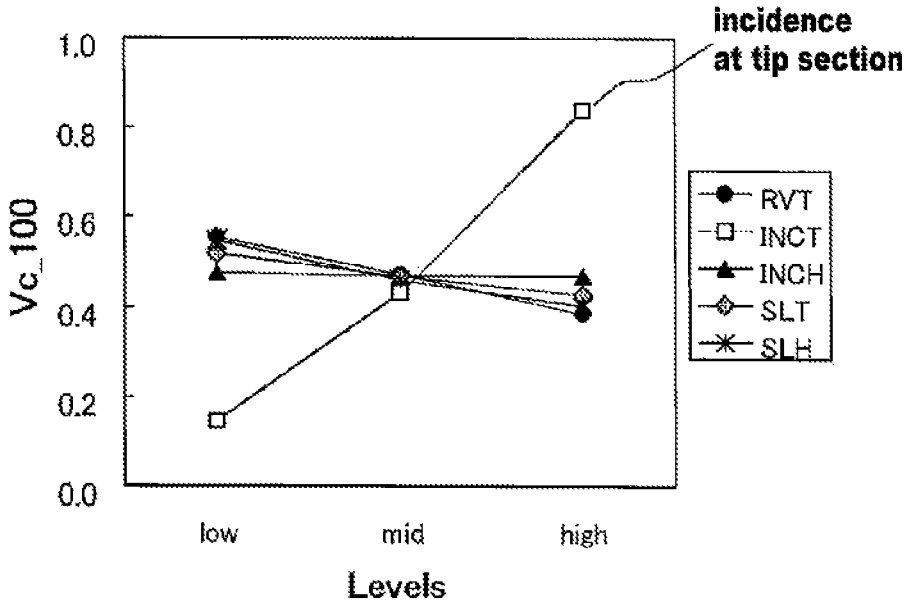
FIG. 9A is a view showing effects of the design parameters on a cavitation volume.
Figure 9B:
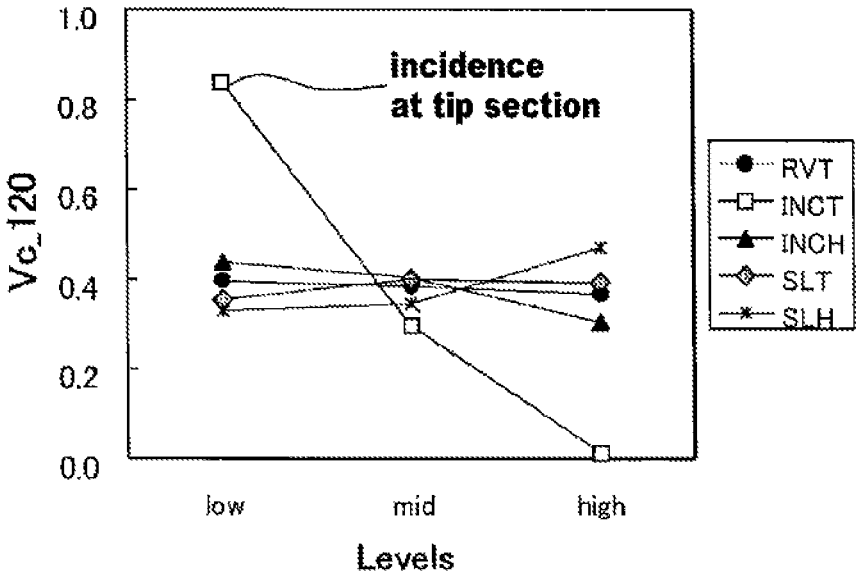
FIG. 9B is a view showing effects of the design parameters on the cavitation volume.
Figure 9C:
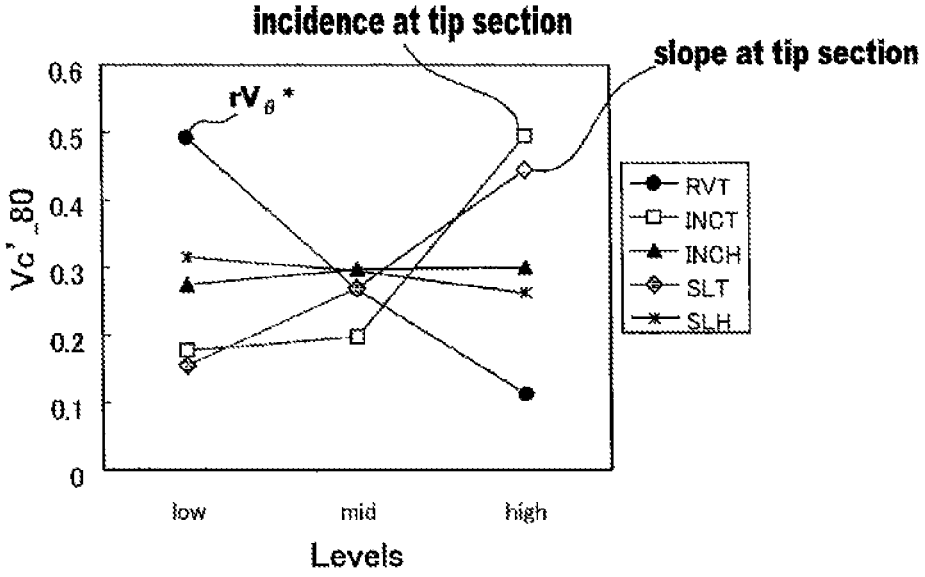
FIG. 9C is a view showing effects of the design parameters on variation in cavitation distributions.

FIGS. 9A, 9B and 9C are views showing effects of the design parameters on the cavitation volume and the variation in cavitation.

As described in FIGS. 8A and 8B, there are five design parameters: RVT, INCT, INCH, SLT, and SLH. The blade geometries are determined by steady CFD with the use of these five design parameters whose levels are changed to low (small), middle (medium), and high (large), and thus 27 blade geometries are determined.

FIG. 9A shows effects, of the design parameters on the cavitation volume $V_c$, which are obtained from results of the cavitation volumes $V_c$ calculated by CFD in the case of 100% Qd and the cavitation number $\sigma$=0.066 with respect to the 27 blade geometries. In FIG. 9A, the horizontal axis represents levels of the design parameters and the vertical axis represents normalized cavitation volume $V_c$. As can be seen from FIG. 9A, when the incidence (INCT) at the tip section is high, the cavitation volume $V_c$ is large, and when the incidence (INCT) at the tip section is low, the cavitation volume $V_c$ is small. Other parameters (RVT, INCH, SLT, SLH) do not significantly affect the cavitation volume $V_c$.

Similarly, FIG. 9B shows effects, of the design parameters on the cavitation volume $V_c$, which are obtained from results of the cavitation volumes $V_c$ calculated by CFD in the case of 120% Qd and the cavitation number $\sigma$=0.15 with respect to the 27 blade geometries. In FIG. 9B, the horizontal axis represents levels of the design parameters and the vertical axis represents normalized cavitation volume $V_c$. As can be seen from FIG. 9B, when the incidence (INCT) at the tip section is low, the cavitation volume $V_c$ is large, and when the incidence (INCT) at the tip section is high, the cavitation volume $V_c$ is small. Other parameters (RVT, INCH, SLT, SLH) do not significantly affect the cavitation volume $V_c$. It is understood that at a large flow rate which exceeds the design flow rate, the suction performance is improved by increasing the incidence (INCT) at the tip section.

Similarly, FIG. 9C shows effects, of the design parameters on the variation in cavitation, which are obtained from results of the variation in the cavitation calculated by CFD in the case of 80% Qd and the cavitation number $\sigma$=0.071 with respect to the 27 blade geometries. In the variation $V_C$', the magnitude of the numerical value indicates the variation in the locations having the peak values in the blade-surface pressure distributions at the inducer tip side (span=0.975) of respective blades. $V_C'$ is calculated from the variance $V_T$ of the formula (1), and is expressed by $V_C'=V_T^{1/2}$. In FIG. 9C, the horizontal axis represents levels of the design parameters and the vertical axis represents the degree of the variation in cavitation. As can be seen from FIG. 9C, when the incidence (INCT) at the tip section is high, the variation $V_C'$ in cavitation is large, and when the incidence (INCT) at the tip section is low, the variation $V_C'$ in cavitation is small. Further, when the slope (SLT) at the tip section is high, the variation $V_C'$ in cavitation is large, and when the slope (SLT) at the tip section is low, the variation $V_C'$ in cavitation is small. Furthermore, when RVT is low, the variation $V_C'$ in cavitation is large, and when RVT is high, the variation $V_C'$ in cavitation is small. Other parameters (INCH, SLH) do not significantly affect the variation $V_C'$ in cavitation.

From the results shown in FIGS. 9A, 9B, 9C, the following judgment can be made.

(1) The degree of development of cavitation evaluated by the largeness of the cavitation volume is significantly affected by the incidence (INCT) at the tip side, and is insignificantly affected by other parameters.

(2) The variation in cavitation at Q/Qd=0.8 is significantly affected by RVT, INCT, SLT. Specifically, it can be predicted that in the case where RVT is low (free vortex design), INCT is high (a large incidence at the tip side) and SLT is high (aft-loading type), cavitation shows large variation and the instability of cavitation behavior is large; and in the case where RVT is high (forced vortex design), INCT is low (a small incidence at the tip side) and SLT is low (fore-loading type), cavitation shows small variation and the stability of cavitation behavior is large.

From the above results, the design result (Comparative Example 1) in which the most unstable cavitation behavior is predicted, and the design result (Inventive Example 1 and Inventive Example 2) in which high suction performance and stable cavitation behavior are predicted, are shown below as representative design results.

TABLE 1 shows design parameters of Comparative Example 1 in which the most unstable cavitation behavior is predicted, and Inventive Example 1 and Inventive Example 2 in which high suction performance and stable cavitation behavior are predicted.

TABLE 1

| Case | $rV_\theta$* type (RVT) | Slope hub (SLH) | Slope tip (SLT) | Incidence hub (INCH) | Incidence tip (INCT) |
|---|---|---|---|---|---|
| Comparative Example 1 | Low | High | High | High | High |
| Inventive Example 1 | High | Low | Low | Mid | High |
| Inventive Example 2 | High | High | Low | High | High |

As shown in TABLE 1, in Comparative Example 1, RVT is small (low), INCT is large (high), and SLT is large (high). Thus, as can be seen from FIG. 9C, with regard to three design parameters (RVT, INCT, SLT) which have the largest effect on the variation in cavitation, all the design parameters are selected in condition so as to cause the variation in cavitation. As can be seen from FIG. 9C, other parameters (INCH, SLH) do not significantly affect the variation in cavitation even in any condition.

On the other hand, in Inventive Example 1 and Inventive Example 2, RVT is large (high), INCT is large (high), and SLT is small (low). Thus, as can be seen from FIG. 9B, with regard to the design parameter (INCT) which has the largest effect on the suction performance (smallness of the cavitation volume) at a high flow rate, the condition of the best suction performance is selected. Further, as can be seen from FIG. 9C, with regard to two, other than INCT, of the three design parameters (RVT, INCT, SLT) which have the effect on the variation in cavitation, both are selected in condition so as to cause the smallest variation in the cavitation volume. As can be seen from FIGS. 9A, 9B, 9C, other design parameters (INCH, SLH) do not significantly affect the suction performance or the variation in cavitation even in any condition.

Figure 10A:
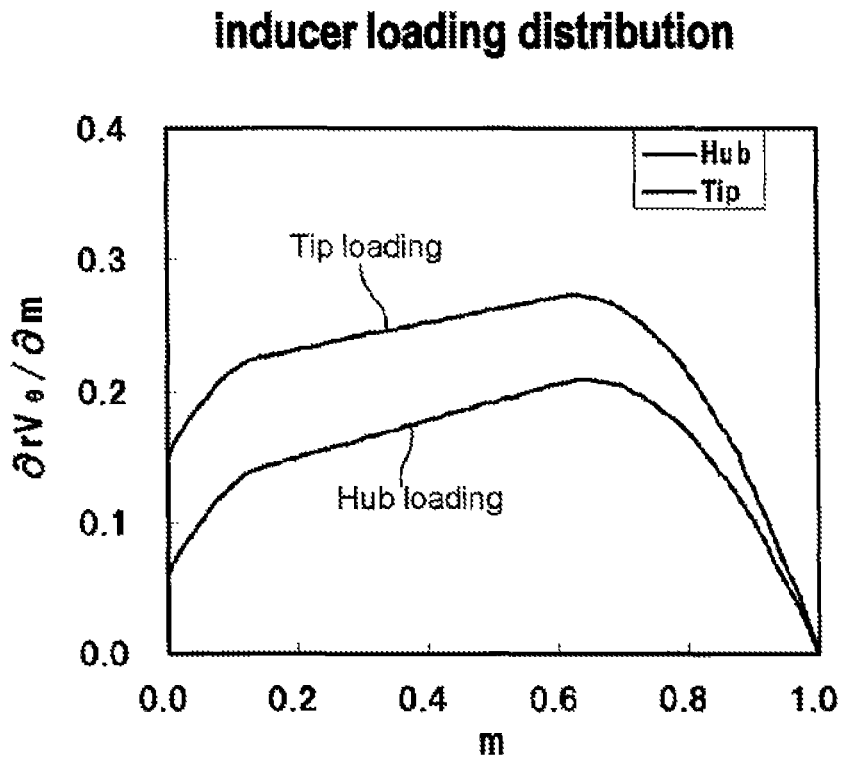
FIG. 10A is a view showing inducer loading distributions.
Figure 10B:
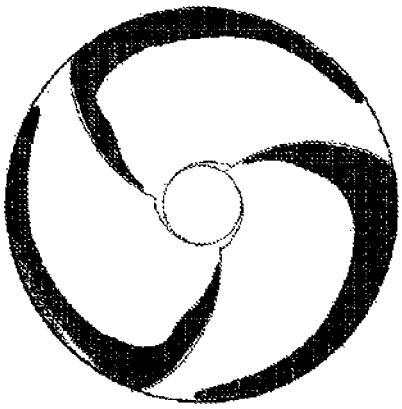
FIG. 10B is a view showing a result in which iso-surface of cavitation void fraction 50% is determined by CFD with regard to the inducer having the loading distributions of FIG. 10A.
Figure 10C:
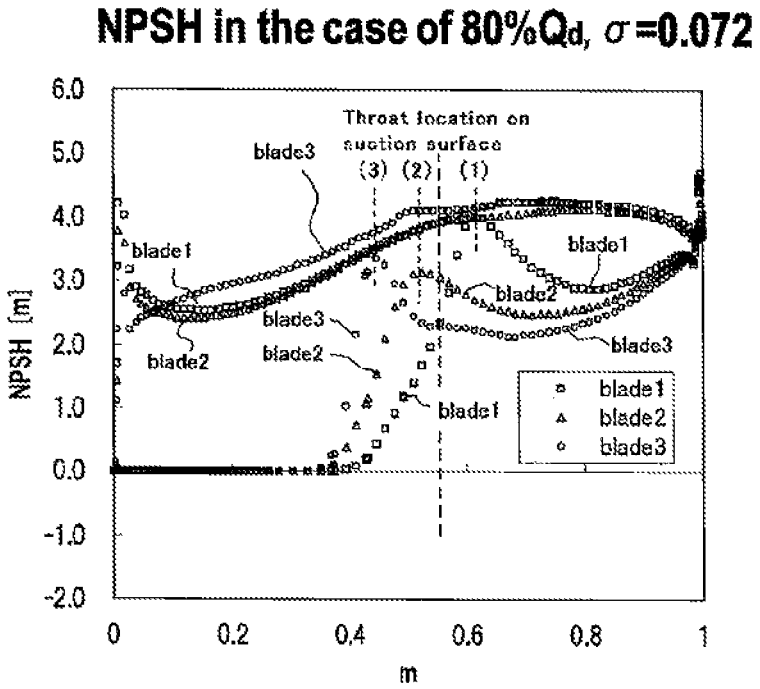
FIG. 10C is a view showing a result in which NPSH (net positive suction head) on blade surfaces are determined by CFD with regard to the inducer having the loading distributions of FIG. 10A.

FIG. 10A is a view showing loading distribution forms used for determining the inducer geometry of Comparative Example 1. FIGS. 10B and 10C are views showing results of iso-surface of cavitation void fraction 50% and NPSH (net positive suction head) on blade surfaces which are determined by CFD with regard to the inducer of Comparative Example 1. FIG. 10B shows a result in which iso-surface of cavitation void fraction 50% is determined, and FIG. 10C shows a result in which NPSH on blade surfaces are determined. As shown in FIG. 10A, the loading distribution at a tip side in Comparative Example 1 shows a slope rising to the right. Thus, in Comparative Example 1, SLT is large and a loading in a rear half is large (aft-loading type). Further, in Comparative Example 1, as can be seen in blade-surface pressure distributions of a suction surface side shown in FIG. 10C, a static pressure surges from a region where NPSH is zero, i.e., the blade-surface pressure is the vapor pressure, toward an inducer outlet side, and static pressures of the respective blades (blade1, blade2, blade3) have their peak values at respective meridional locations shown by (1), (2), (3). In this manner, when the meridional locations (1), (2), (3) having the peak values of the static pressures show large variation, it can be evaluated that the instability of cavitation behavior is large.

Figure 11A:
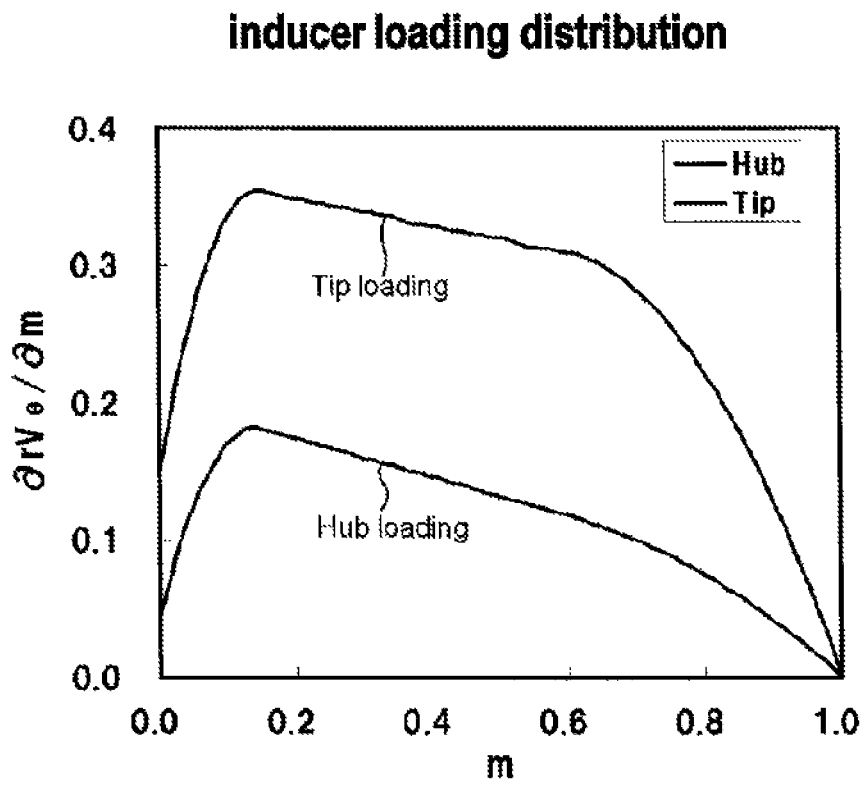
FIG. 11A is a view showing loading distributions of the inducer.
Figure 11B:
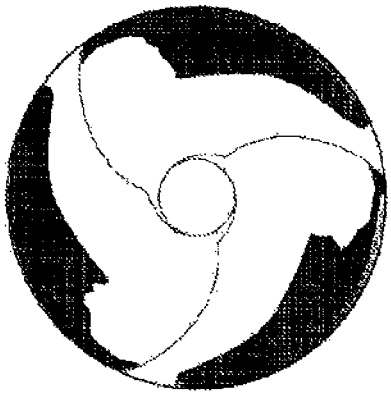
FIG. 11B is a view showing a result in which iso-surface of cavitation void fraction 50% is determined by CFD with regard to the inducer having the loading distributions of FIG. 11A.
Figure 11C:
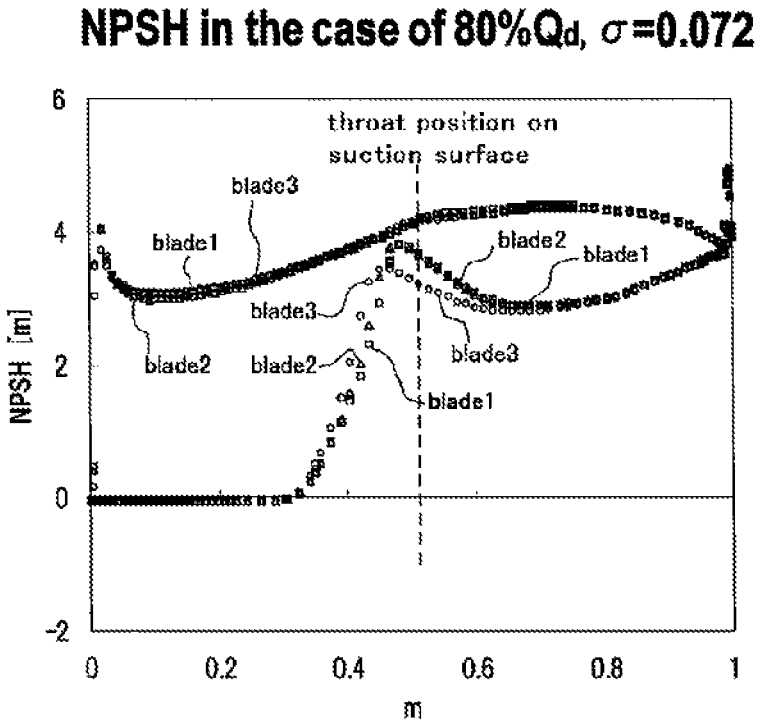
FIG. 11C is a view showing a result in which NPSH (net positive suction head) on blade surfaces are determined by CFD with regard to the inducer having the loading distributions of FIG. 11A.

FIG. 11A is a view showing loading distribution forms used for determining the inducer geometry of Inventive Example 1. FIGS. 11B and 11C are views showing results of inducer loading distribution, iso-surface of cavitation void fraction 50%, and NPSH (net positive suction head) on blade surfaces which are determined by CFD with regard to the inducer of Inventive Example 1. FIG. 11B shows a result in which iso-surface of cavitation void fraction 50% is determined, and FIG. 11C shows a result in which NPSH on blade surfaces are determined. As shown in FIG. 11A, the loading distribution at a tip side in Inventive Example 1 shows a slope declining to the right. Thus, in Inventive Example 1, SLT is small and a loading in a front half is large (fore-loading type). Further, as shown in FIG. 11B, cavitation distributions, shown by black colored portions, developed on respective blade surfaces of the inducer do not have variation. Furthermore, in Inventive Example 1, as can be seen in blade-surface pressure distributions of a suction surface side shown in FIG. 11C, a static pressure surges from a region where NPSH is zero, i.e., the blade-surface pressure is the vapor pressure, toward an inducer outlet side, and static pressures of the respective blades (blade1, blade2, blade3) have their peak values at respective meridional locations in the vicinity of m=0.45. In this manner, when the meridional locations having the peak values of the static pressure show small variation, it can be evaluated that the stability of cavitation behavior is large.

Figure 12A:
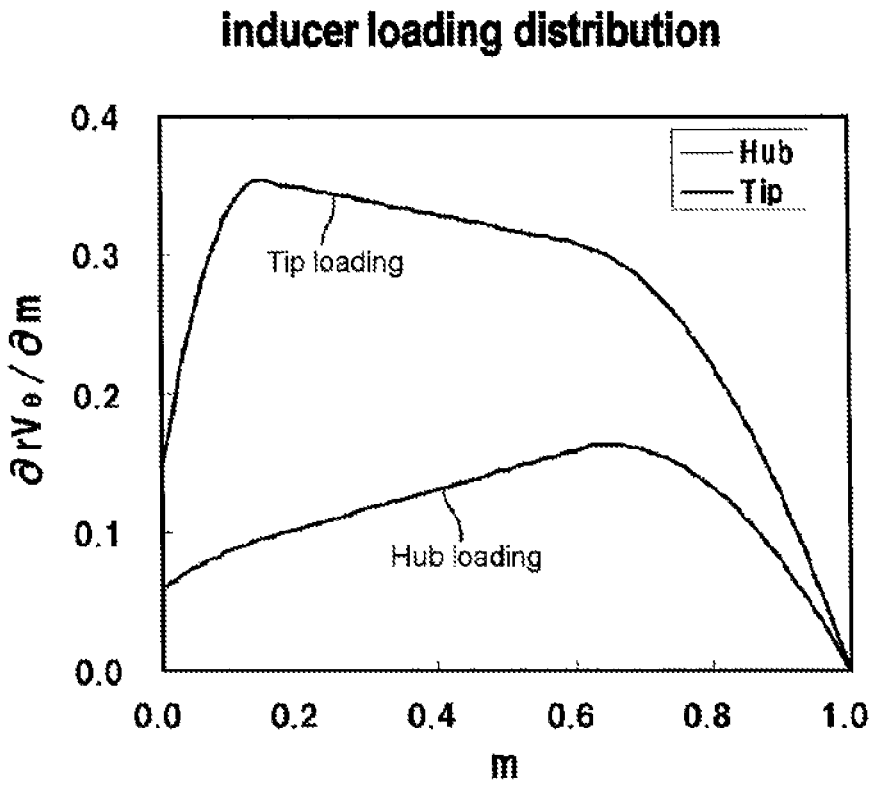
FIG. 12A is a view showing loading distributions of the inducer.
Figure 12B:
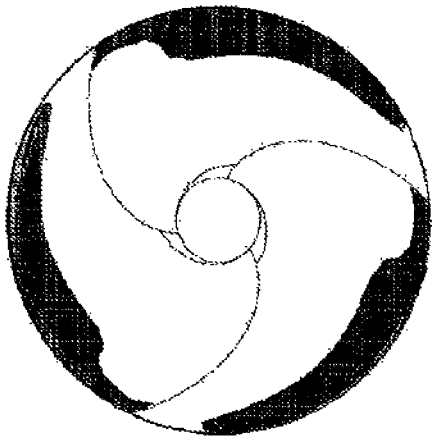
FIG. 12B is a view showing a result in which iso-surface of cavitation void fraction 50% is determined by CFD with regard to the inducer having the loading distributions of FIG. 12A.
Figure 12C:
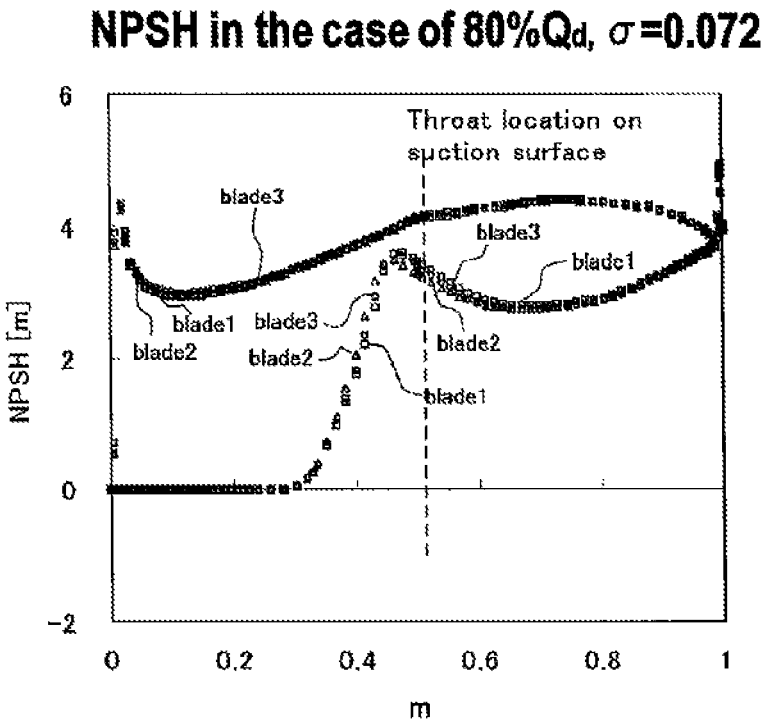
FIG. 12C is a view showing a result in which NPSH (net positive suction head) on blade surfaces are determined by CFD with regard to the inducer having the loading distributions of FIG. 12A.

FIG. 12A is a view showing loading distribution forms used for determining the inducer geometry of Inventive Example 2. FIGS. 12B and 12C are views showing results of iso-surface of cavitation void fraction 50% and NPSH (net positive suction head) on blade surfaces which are determined by CFD with regard to the inducer of Inventive Example 2. FIG. 12B shows a result in which iso-surface of cavitation void fraction 50% is determined, and FIG. 12C shows a result in which NPSH on blade surfaces are determined. As shown in FIG. 12A, the loading distribution at a tip side in Inventive Example 2 shows a slope declining to the right. Thus, in Inventive Example 2, SLT is small and a loading in a front half is large (fore-loading type). Further, as shown in FIG. 12B, cavitation distributions, shown by black colored portions, developed on respective blade surfaces of the inducer do not have variation. Furthermore, in Inventive Example 2, as can be seen in blade-surface pressure distributions of a suction surface side shown in FIG. 12C, a static pressure surges from a region where NPSH is zero, i.e., the blade-surface pressure is the vapor pressure, toward an inducer outlet side, and static pressures of the respective blades (blade1, blade2, blade3) have their peak values at respective meridional locations in the vicinity of m=0.45. In this manner, when the meridional locations having the peak values of the static pressure show small variation, it can be evaluated that the stability of cavitation behavior is large.

Figure 13A:
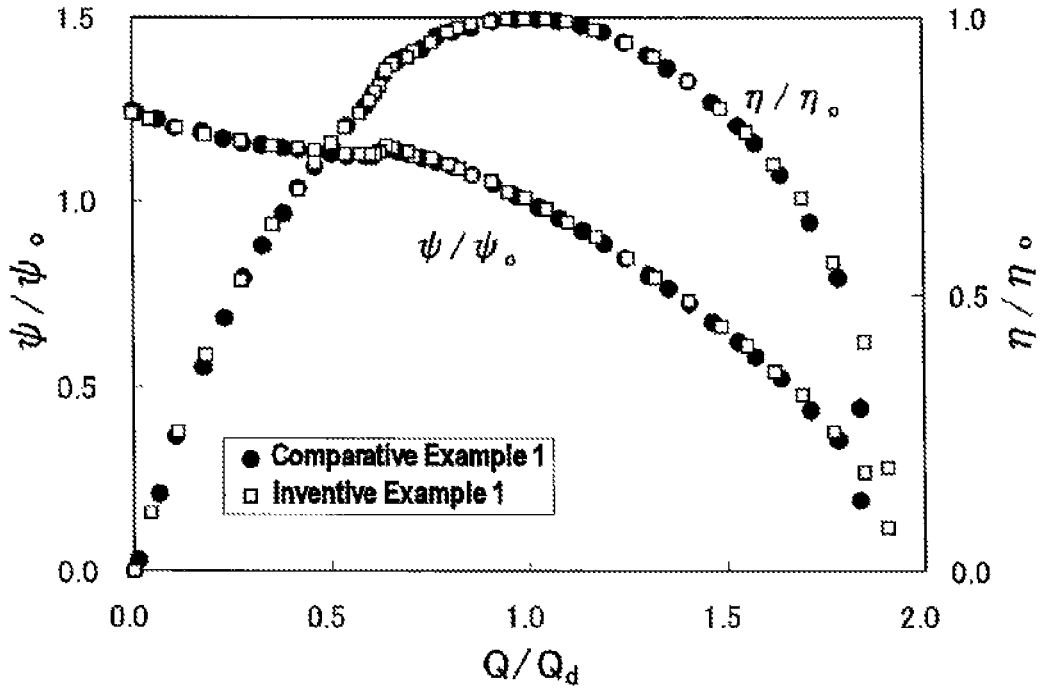
FIG. 13A is a view showing a result in which the inducer shown in FIGS. 10A, 10B, 10C and the inducer shown in FIGS. 11A, 11B, 11C are incorporated in test pumps, and the pump performance is confirmed.
Figure 13B:
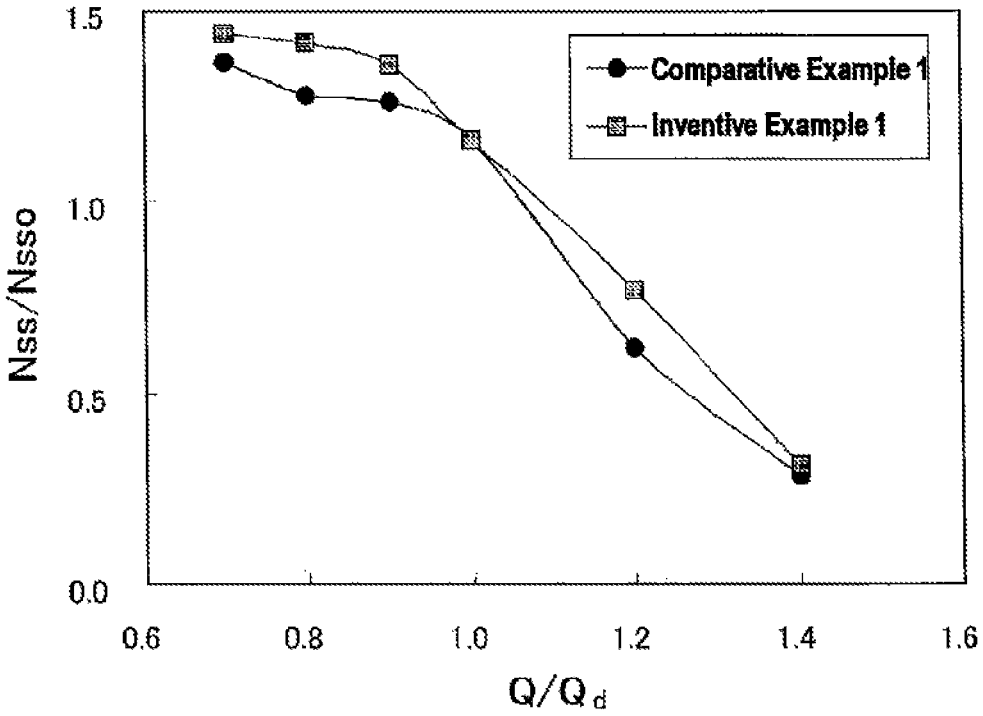
FIG. 13B is a view showing a result in which the inducer shown in FIGS. 10A, 10B, 10C and the inducer shown in FIGS. 11A, 11B, 11C are incorporated in test pumps, and the pump suction performance is confirmed.

FIGS. 13A and 13B are views showing results in which the inducer of Comparative Example 1 shown in FIGS. 10A, 10B, 10C and the inducer of Inventive Example 1 shown in FIGS. 11A, 11B, 11C are incorporated in test pumps, and the pump performance is confirmed. FIG. 13A shows head characteristics and efficiency of the pump incorporating the inducer of Comparative Example 1 and the pump incorporating the inducer of Inventive Example 1, and FIG. 13B shows suction specific speed of the pump incorporating the inducer of Comparative Example 1 and the pump incorporating the inducer of Inventive Example 1. As shown in FIG. 13A, it is understood that the head characteristics and the efficiency of the pump incorporating the inducer of Comparative Example 1 and the pump incorporating the inducer of Inventive Example 1 are substantially the same and do not vary with each other except for an excessive flow rate side where Q/Qd is 1.7 or more. As shown in FIG. 13B, it is understood that the pump incorporating the inducer of Inventive Example 1 has better suction performance than the pump incorporating the inducer of Comparative Example 1 in both a large flow rate side and a small flow rate side. In this manner, the superiority in the suction performance of the inducer of Inventive Example 1 which has been predicted according to the optimum design process has been confirmed.

Figure 14A:
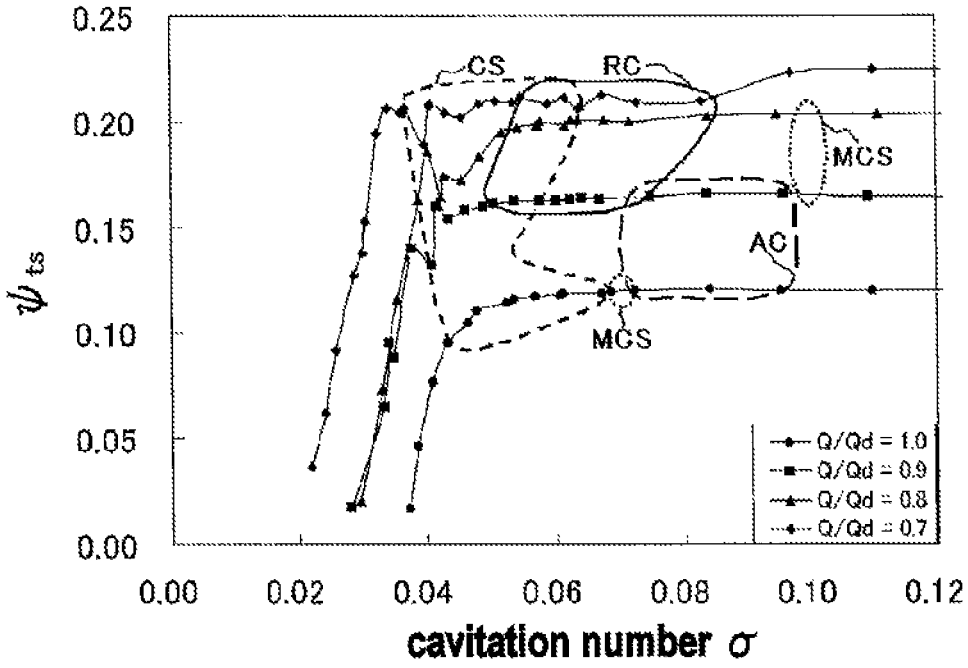
FIG. 14A is a view showing suction performance curves represented by static pressure coefficients which are measured at the tip side of an inducer outlet with regard to the inducer shown in FIGS. 10A, 10B, 10C.
Figure 14B:
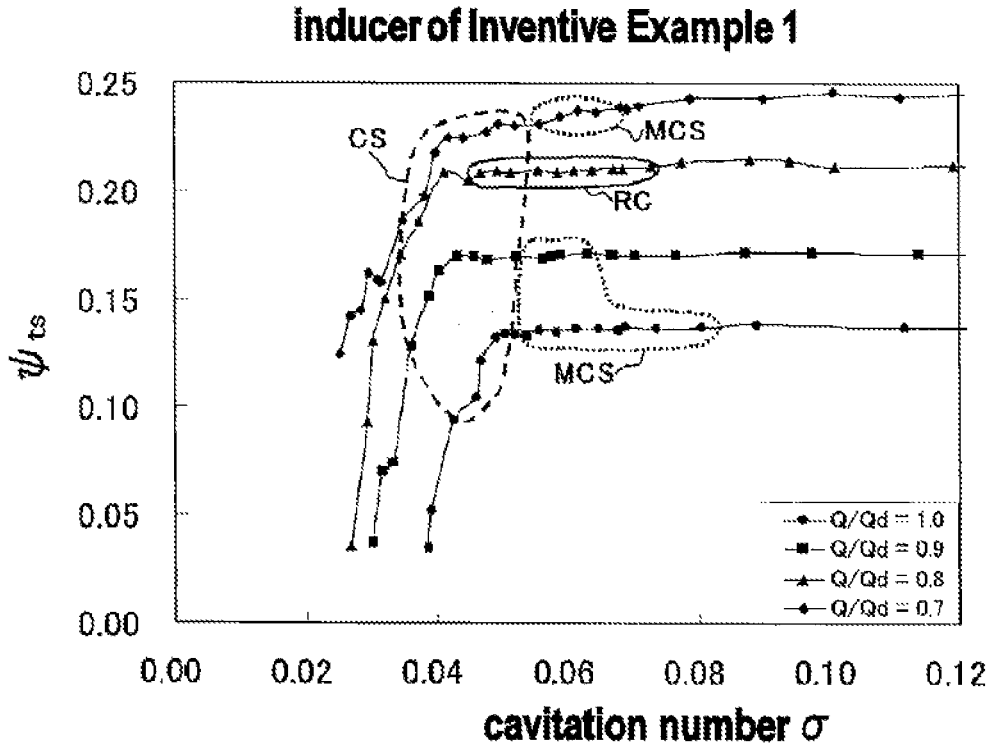
FIG. 14B is a view showing suction performance curves represented by static pressure coefficients which are measured at the tip side of an inducer outlet with regard to the inducer shown in FIGS. 11A, 11B, 11C.

FIGS. 14A and 14B are views showing suction performance curves represented by static pressure coefficients which are measured at the tip side of the inducer outlet with regard to the inducer of Comparative Example 1 and the inducer of Inventive Example 1. In FIGS. 14A and 14B, regions where the instability phenomena of cavitation appear are mapped with the frame borders in the figures.

As shown in FIG. 14A, in the inducer of Comparative Example 1, the rotating cavitation (RC) is generated in the flow rate ratio Q/Qd=0.9, 0.8 and 0.7. Further, the asymmetrical cavitation (AC) is generated in the flow rate ratio Q/Qd=1.0 and 0.9. Furthermore, the mild cavitation surge fluctuations (MCS) are generated right before the generation of cavitation surge in the flow rate ratio Q/Qd=1.0, and in the vicinity of the cavitation number $\sigma$=0.1 in the flow rate ratio Q/Qd=0.9, 0.8.

As shown in FIG. 14B, in the inducer of Inventive Example 1, the rotating cavitation (RC) is generated only in the flow rate ratio Q/Qd=0.8. Further, the asymmetrical cavitation (AC) is not generated. In the flow rate ratio Q/Qd=1.0 and 0.9, the mild cavitation surge fluctuations (MCS) are generated in the cavitation number $\sigma$ larger than the cavitation number $\sigma$ where cavitation surge is generated. However, it is understood that the instability phenomena of the inducer of Inventive Example 1 are milder than that of the inducer of Comparative Example 1, and thus the inducer of Inventive Example 1 has higher stability.

From the above, the superiority in the stability and the suction performance of the inducer of Inventive Example 1 which has been predicted according to the optimum design process has been confirmed by the experiments.

Figure 15:
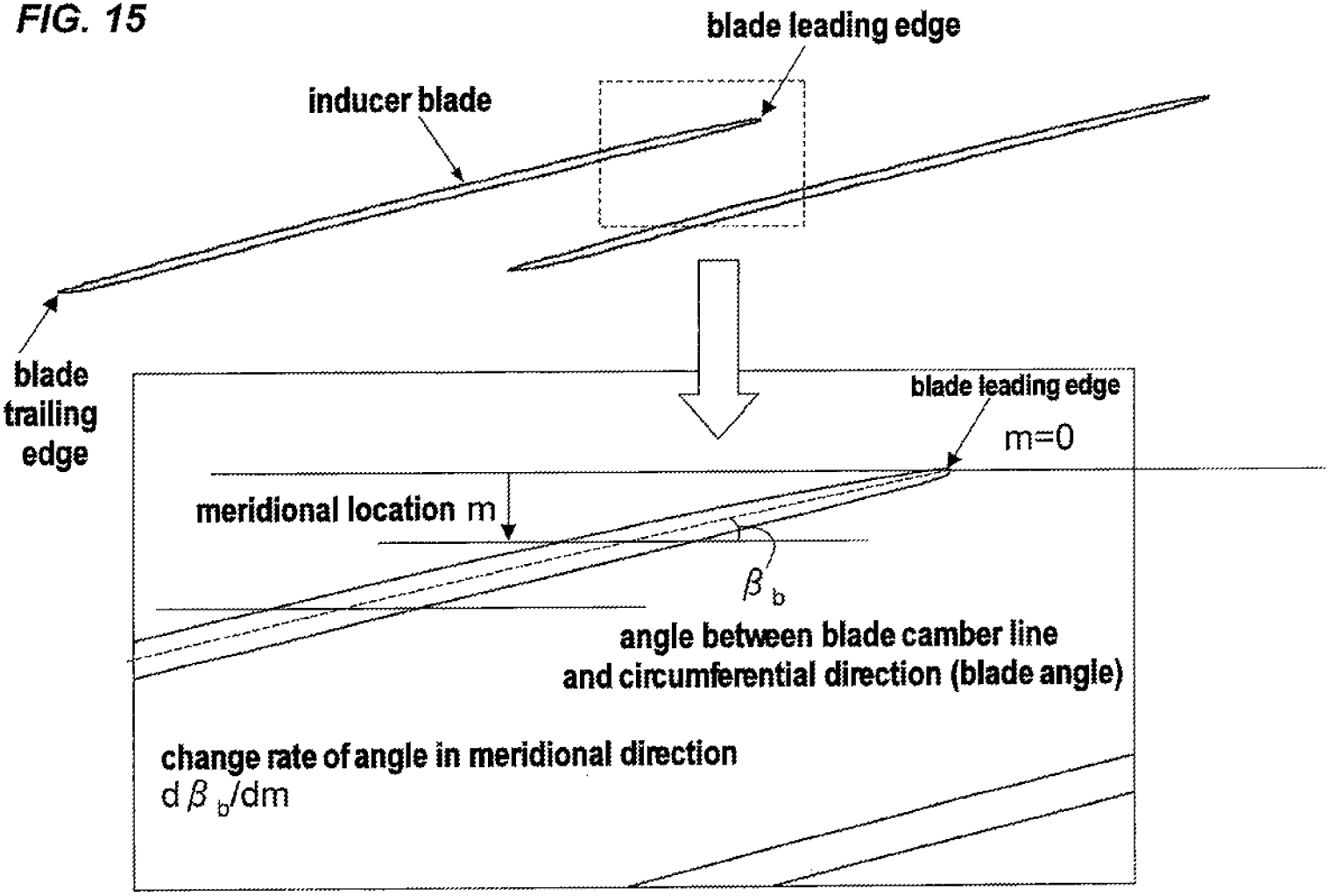
FIG. 15 is a view showing a meridional location and a blade angle $\beta_b$, and a change rate $d\beta_b/dm$ of a blade angle in a meridional direction in the inducer.

Next, blade angle distributions of the inducers in Comparative Example 1, Inventive Example 1 and Inventive Example 2 will be compared. FIG. 15 is a view showing a meridional location and a blade angle $\beta_b$, and a change rate $d\beta_b/dm$ of a blade angle in a meridional direction in the inducer. Specifically, FIG. 15 shows a geometry of an inducer blade (upper view) and an enlarged view of a dotted line portion (lower view), wherein the enlarged view shows the angle (blade angle) $\beta_b$ between a blade camber line and the circumferential direction in a non-dimensional meridional location m, and the change rate $d\beta_b/dm$ of the blade angle in the meridional direction.

Figure 16:
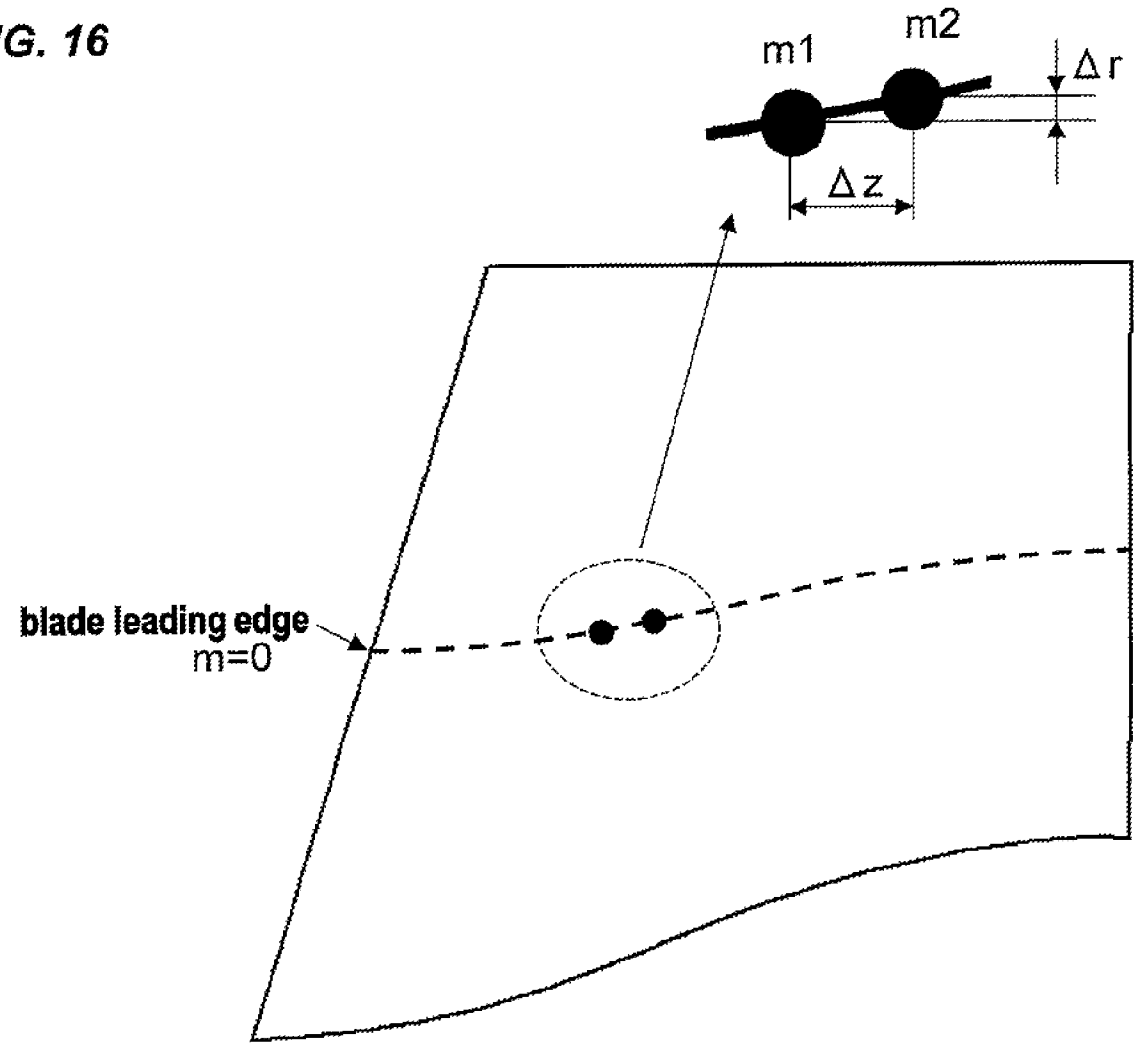
FIG. 16 is a view for explanation of a definition of a change of non-dimensional meridional location.

FIG. 16 is a view for explanation of a definition of a change of non-dimensional meridional location. Specifically, FIG. 16 shows non-dimensional meridional locations specified by two points on a meridional geometry of the inducer and an enlarged view of a portion including the two points, wherein the enlarged view shows the relationship between the two points, m1 and m2. Here, when the change of non-dimensional meridional location is expressed by $\Delta m$, m2 is expressed by $m2=m1+\Delta m$, and $\Delta m$ is expressed by $\Delta m=((\Delta Z)^2+(\Delta r)^2)^{0.5}$.

Figure 17A:
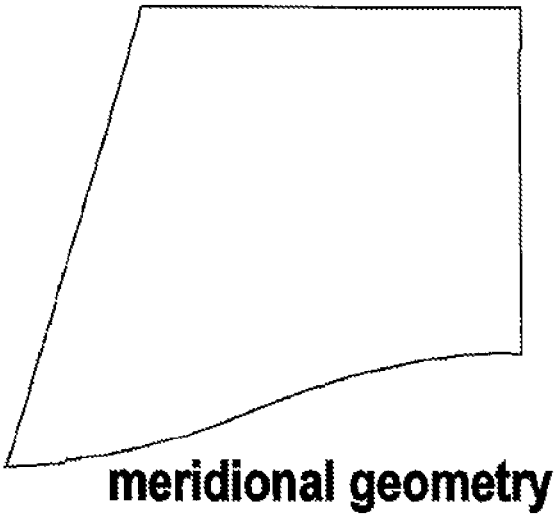
FIG. 17A is a view showing a design meridional geometry of Comparative Example 1, Inventive Example 1 and Inventive Example 2.

FIG. 17A is a view showing a design meridional geometry of Comparative Example 1, Inventive Example 1 and Inventive Example 2. As shown in FIG. 17A, in these design examples, a tip side is configured to be a straight line parallel to an axial direction of a main shaft, and a hub side is configured to be a curved shape.

Figure 17B:
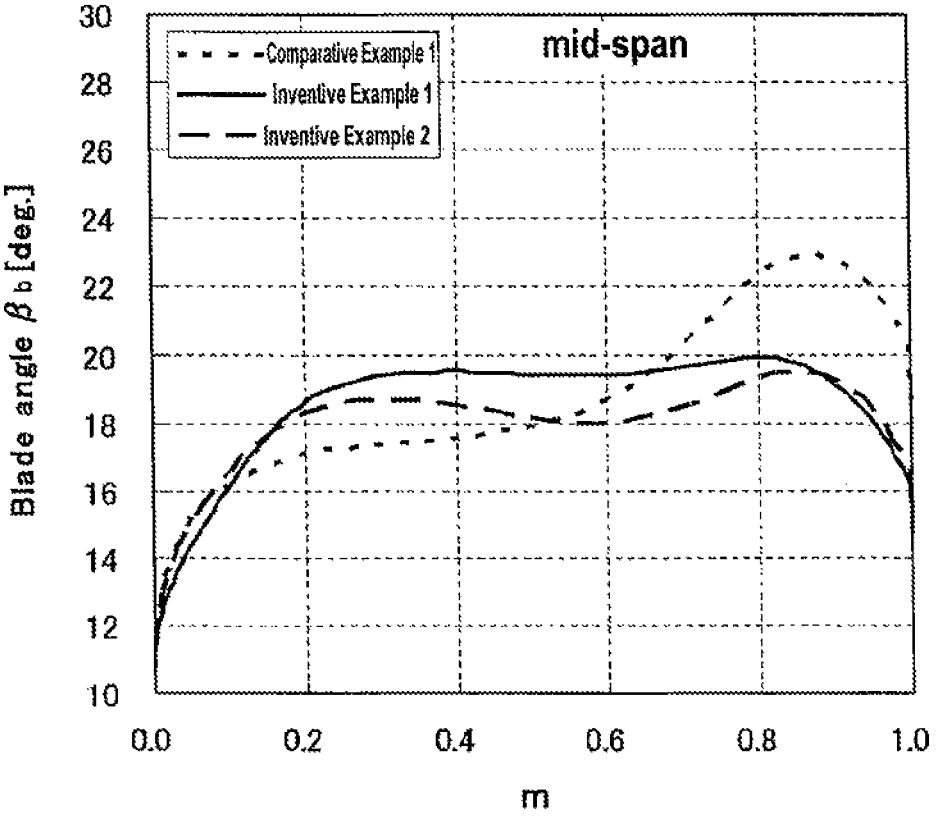
FIG. 17B is a graph in which angle distributions at a mid-span are compared in the case of the design meridional geometry of Comparative Example 1, Inventive Example 1 and Inventive Example 2.
Figure 17C:
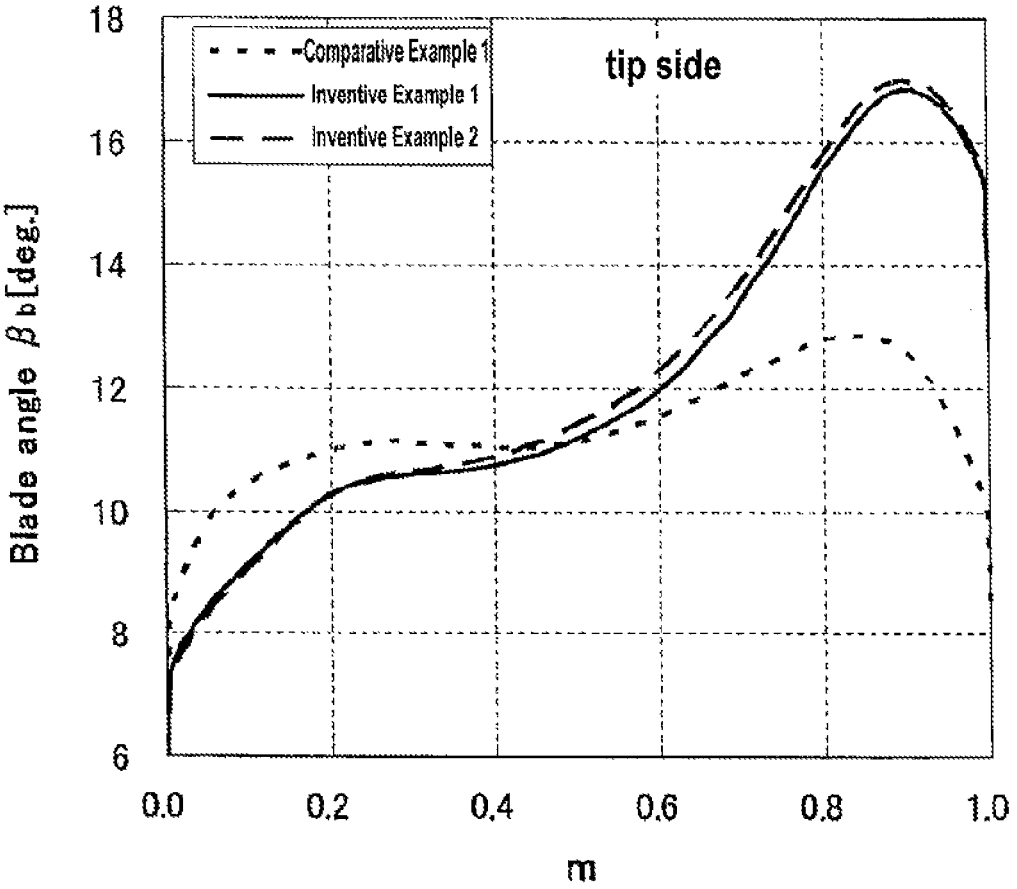
FIG. 17C is a graph in which angle distributions at a tip side are compared in the case of the design meridional geometry of Comparative Example 1, Inventive Example 1 and Inventive Example 2.

FIGS. 17B and 17C are graphs in which angle distributions at a mid-span and at a tip side are compared in the case of the design meridional geometry of Comparative Example 1, Inventive Example 1 and Inventive Example 2. In FIGS. 17B and 17C, the horizontal axis represents non-dimensional meridional location (m) and the vertical axis represents blade angle ($\beta b$). As shown in FIGS. 17B and 17C, in Inventive Example 1 and Inventive Example 2 where the cavitation behavior is stable, the blade geometries at the tip side are characterized in that the blade angle increases from a blade leading edge to the non-dimensional meridional location of 0.2, and an increase rate of the blade angle with respect to the meridional distance decreases from 0.2 to 0.5 in the non-dimensional meridional location, but the blade angle increases again from 0.5 to approximately 0.85 in the non-dimensional meridional location, and the blade angle decreases from the non-dimensional meridional location of approximately 0.85 to a blade trailing edge. Further, the blade geometries at the mid-span are characterized in that the blade angle increases from the blade leading edge to the non-dimensional meridional location of 0.2. The blade geometries at the tip side in Inventive Example 1 and Inventive Example 2 are such blade geometries that from 0.2 to 0.5 in the non-dimensional meridional location, the increase rate of the blade angle decreases, but the blade angle itself does not decrease.

Figure 18A:
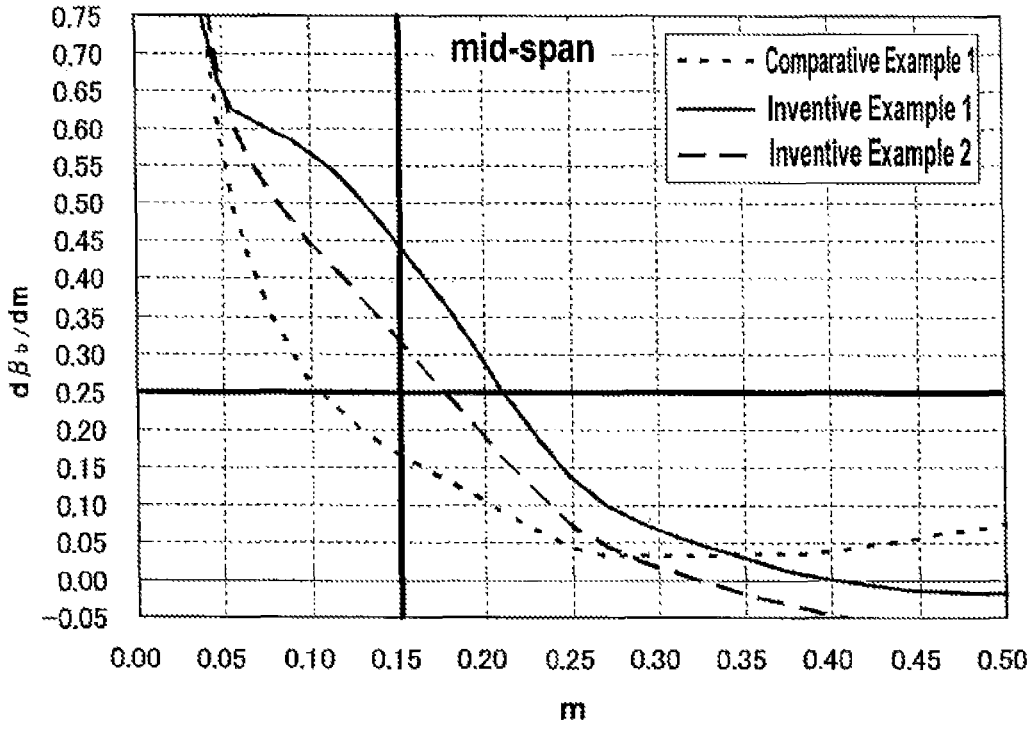
FIG. 18A is a view showing the change rate $d\beta_b/dm$ of the blade angle in the meridional direction at the mid-span from a blade leading edge (m=0) to a blade middle portion (m=0.50) in Comparative Example 1, Inventive Example 1 and Inventive Example 2.
Figure 18B:
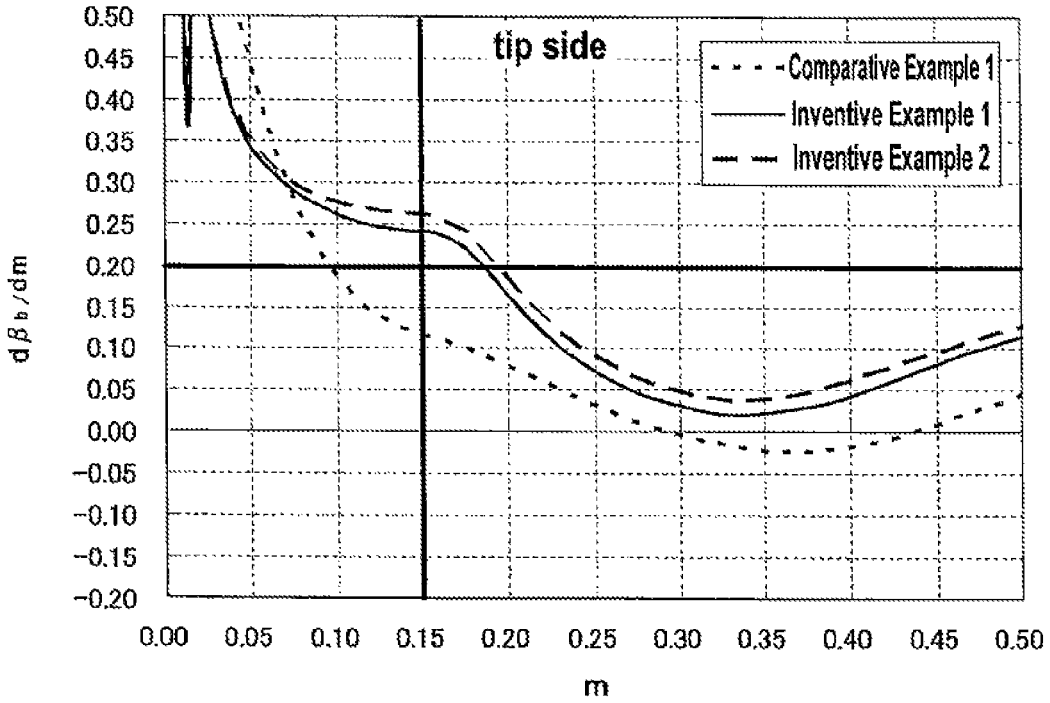
FIG. 18B is a view showing the change rate $d\beta_b/dm$ of the blade angle in the meridional direction at the tip side from the blade leading edge (m=0) to the blade middle portion (m=0.50) in Comparative Example 1, Inventive Example 1 and Inventive Example 2.

FIGS. 18A and 18B are views showing the change rates $d\beta_b/dm$ of the blade angle in the meridional direction, at the mid-span and at the tip side, from the blade leading edge (m=0) to a blade middle portion (m=0.50) in Comparative Example 1, Inventive Example 1 and Inventive Example 2.

From FIGS. 18A and 18B, it is understood that Inventive Example 1 and Inventive Example 2 where the cavitation behavior is stable are characterized in that the increase rate $d\beta_b/dm$ of the blade angle at the tip side is not less than 0.2 from the blade leading edge to the non-dimensional meridional location of 0.15, and the increase rate $d\beta_b/dm$ of the blade angle at the mid-span is not less than 0.25 from the blade leading edge to the non-dimensional meridional location of 0.15. More specifically, Inventive Example 1 and Inventive Example 2 are characterized in that the increase rate $d\beta_b/dm$ of the blade angle at the tip side is 0.2 to 2.0 from the blade leading edge to the non-dimensional meridional location of 0.15, and the increase rate $d\beta_b/dm$ of the blade angle at the mid-span is 0.25 to 2.0 from the blade leading edge to the non-dimensional meridional location of 0.15.

Figure 19A:
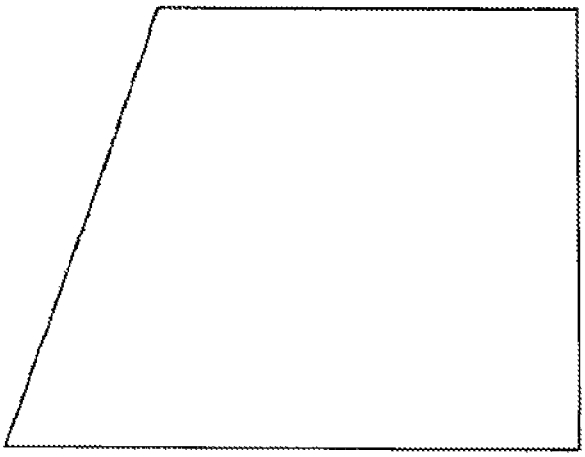
FIG. 19A is a view showing a design meridional geometry of Comparative Example 2, Inventive Example 3 and Inventive Example 4 which relate to inducer blades designed by using the same loading distribution as Comparative Example 1, Inventive Example 1 and Inventive Example 2 respectively.

FIG. 19A is a view showing a design meridional geometry of Comparative Example 2, Inventive Example 3 and Inventive Example 4 which relate to inducer blades designed by using the same loading distribution as Comparative Example 1, Inventive Example 1 and Inventive Example 2 respectively. As shown in FIG. 19A, in these design examples, both of a tip side and a hub side are configured to be straight lines parallel to an axial direction of a main shaft.

Figure 19B:
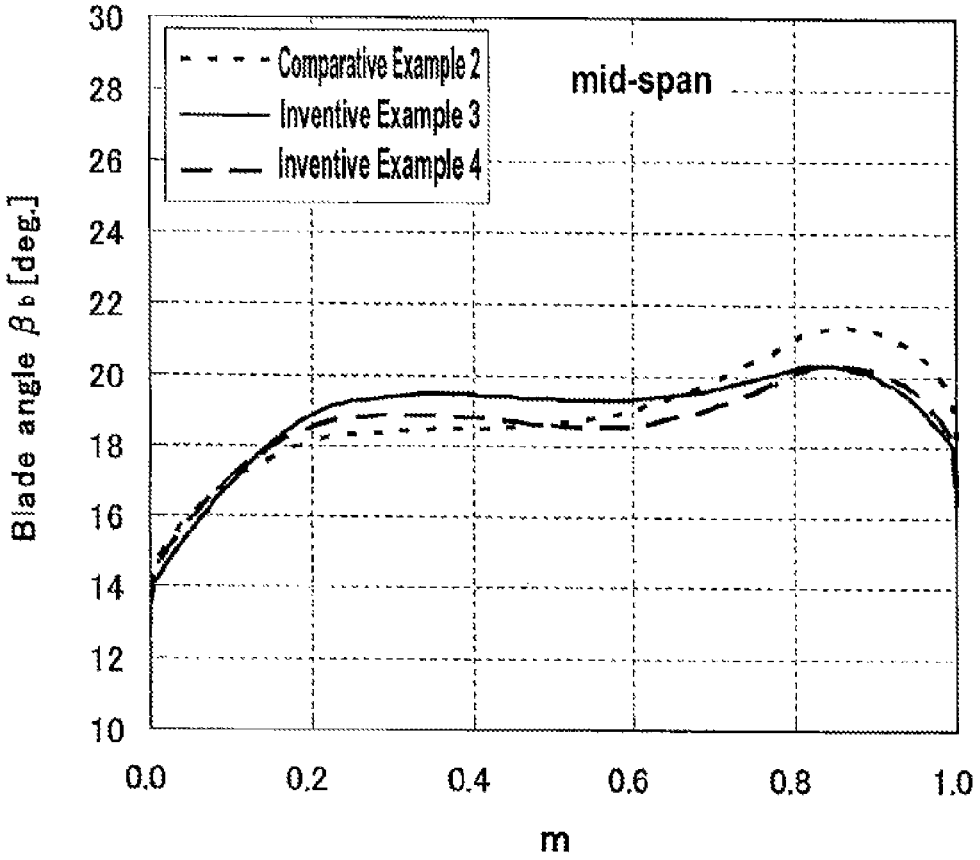
FIG. 19B is a graph in which angle distributions at a mid-span are compared in the case of the design meridional geometry of Comparative Example 2, Inventive Example 3 and Inventive Example 4.
Figure 19C:
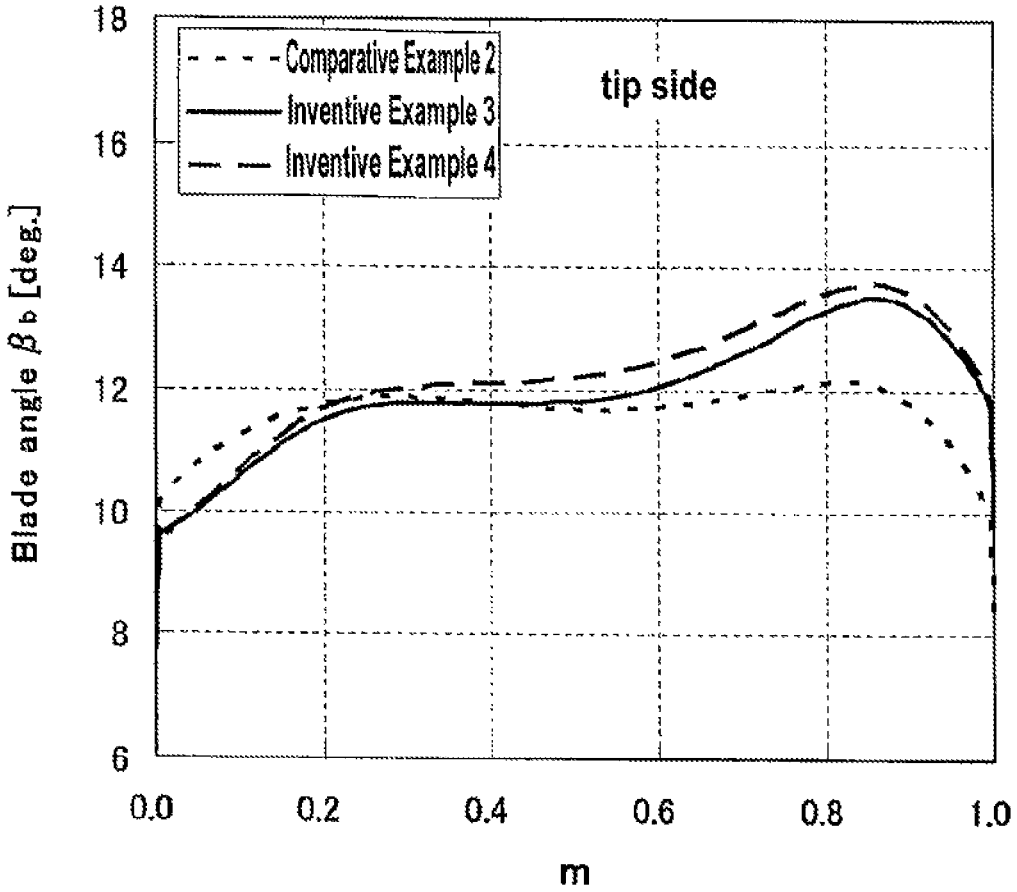
FIG. 19C is a graph in which angle distributions at a tip side are compared in the case of the design meridional geometry of Comparative Example 2, Inventive Example 3 and Inventive Example 4.

FIGS. 19B and 19C are graphs in which angle distributions at a mid-span and at a tip side are compared in the case of the design meridional geometry of Comparative Example 2, Inventive Example 3 and Inventive Example 4. In FIGS. 19B and 19C, the horizontal axis represents non-dimensional meridional location (m) and the vertical axis represents blade angle (βb). As shown in FIGS. 19B and 19C, in Inventive Example 3 and Inventive Example 4 where the cavitation behavior is stable, the blade geometries at the tip side are characterized in that the blade angle increases from a blade leading edge to the non-dimensional meridional location of 0.2, and an increase rate of the blade angle with respect to the meridional distance decreases from 0.2 to 0.5 in the non-dimensional meridional location, but the blade angle increases again from 0.5 to approximately 0.85 in the non-dimensional meridional location, and the blade angle decreases from the non-dimensional meridional location of approximately 0.85 to a blade trailing edge. Further, the blade geometries at the mid-span are characterized in that the blade angle increases from the blade leading edge to the non-dimensional meridional location of 0.2. The blade geometries of Inventive Example 3 and Inventive Example 4 are such blade geometries that from 0.2 to 0.5 in the non-dimensional meridional location, the increase rate of the blade angle decreases, but the blade angle itself does not decrease.

Figure 20A:
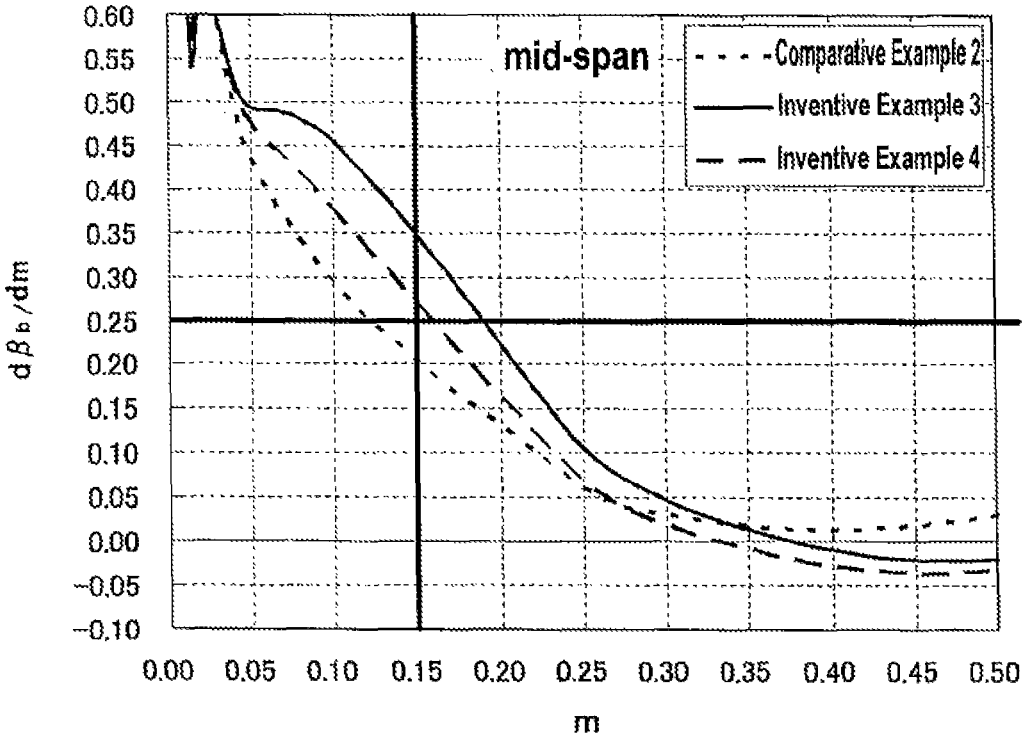
FIG. 20A is a view showing the change rate $d\beta_b/dm$ of the blade angle in the meridional direction at the mid-span from a blade leading edge (m=0) to a blade middle portion (m=0.50) in Comparative Example 2, Inventive Example 3 and Inventive Example 4.
Figure 20B:
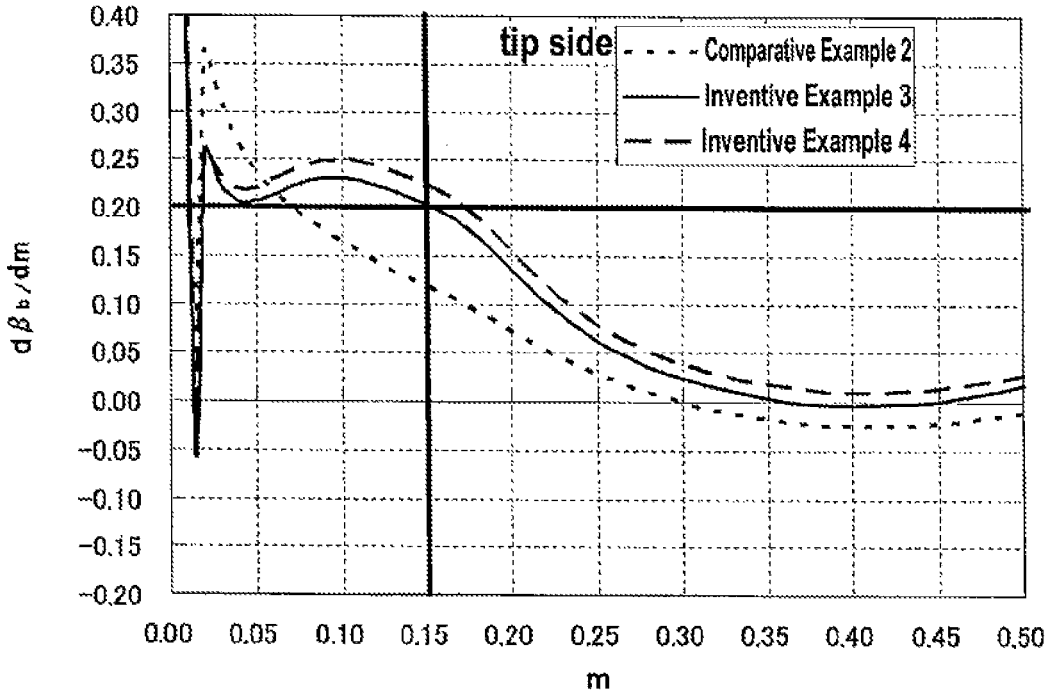
FIG. 20B is a view showing the change rate $d\beta_b/dm$ of the blade angle in the meridional direction at the tip side from the blade leading edge (m=0) to the blade middle portion (m=0.50) in Comparative Example 2, Inventive Example 3 and Inventive Example 4.

FIGS. 20A and 20B are views showing the change rates $d\beta_b/dm$ of the blade angle in the meridional direction, at the mid-span and at the tip side, from the blade leading edge (m=0) to a blade middle portion (m=0.50) in Comparative Example 2, Inventive Example 3 and Inventive Example 4.

From FIGS. 20A and 20B, it is understood that Inventive Example 3 and Inventive Example 4 where the cavitation behavior is stable are characterized in that the increase rate $d\beta_b/dm$ of the blade angle at the tip side is not less than 0.2 from the blade leading edge to the non-dimensional meridional location of 0.15, and the increase rate $d\beta_b/dm$ of the blade angle at the mid-span is not less than 0.25 from the blade leading edge to the non-dimensional meridional location of 0.15. More specifically, Inventive Example 3 and Inventive Example 4 are characterized in that the increase rate $d\beta_b/dm$ of the blade angle at the tip side is 0.2 to 2.0 from the blade leading edge to the non-dimensional meridional location of 0.15, and the increase rate $d\beta_b/dm$ of the blade angle at the mid-span is 0.25 to 2.0 from the blade leading edge to the non-dimensional meridional location of 0.15.

These characteristics are the same as those in Comparative Example 1, Inventive Example 1 and Inventive Example 2.

Although the embodiment of present invention has been described above, the present invention is not limited to the above embodiment, but may be reduced to practice in various different manners within the scope of the technical concept thereof.

INDUSTRIAL APPLICABILITY

The present invention is applicable to an inducer geometry which can optimize the behavior stability of cavitation in an inducer having a plurality of blades of the same geometry.

REFERENCE SIGNS LIST

1 inducer
1*le* blade leading edge
1*te* blade trailing edge
1H inducer hub
1T inducer tip
2 impeller
3 main shaft

The invention claimed is:

1. An inducer provided at an upstream side of an impeller and having a plurality of blades of the same geometry, wherein:

a blade loading at a tip side in a front half of a blade is larger than that in a rear half of the blade, the blade loading at the tip side being loaded from a tip blade leading edge; and when a blade angle from a circumferential direction of the inducer is expressed by $\beta_b$ (degree) and a meridional distance is expressed by m (mm), an increase rate $d\beta_b/dm$ of the blade angle at the tip side is not less than 0.2°/mm from a blade leading edge to a non-dimensional meridional location of 0.15, and the increase rate $d\beta_b/dm$ of the blade angle at a mid-span is not less than 0.25°/mm from the blade leading edge to the non-dimensional meridional location of 0.15.

2. The inducer according to claim 1, wherein:

a blade geometry at the tip side is such blade geometry that the blade angle increases from the blade leading edge to the non-dimensional meridional location of 0.2, the increase rate of the blade angle with respect to the meridional distance decreases from 0.2 to 0.5 in the non-dimensional meridional location, the blade angle increases again from 0.5 to approximately 0.85 in the non-dimensional meridional location, and the blade angle decreases from the non-dimensional meridional location of approximately 0.85 to a blade trailing edge; and a blade geometry at the mid-span is such blade geometry that the blade angle increases from the blade leading edge to the non-dimensional meridional location of 0.2.

3. The inducer according to claim 2, wherein:

the blade geometry at the tip side is such blade geometry that from 0.2 to 0.5 in the non-dimensional meridional location, the increase rate of the blade angle with respect to the meridional distance decreases, but the blade angle itself does not decrease.

4. A pump comprising:

an inducer according to claim 1, an impeller disposed at a downstream side of the inducer; and a main shaft configured to support the inducer and the impeller.

5. The inducer according to claim 1, wherein:

the increase rate $d\beta_b/dm$ of the blade angle at the tip side is in the range of 0.2°/mm to 2.0°/mm from the blade leading edge to the non-dimensional meridional location of 0.15, and the increase rate $d\beta_b/dm$ of the blade angle at the mid-span is in the range of 0.25°/mm to 2.0°/mm from the blade leading edge to the non-dimensional meridional location of 0.15.

* * * * *